US005808653A

United States Patent [19]

Matsumoto et al.

[11] Patent Number: 5,808,653

[45] Date of Patent: Sep. 15, 1998

[54] THERMAL GRADATION PRINTING APPARATUS

[75] Inventors: Yasuki Matsumoto, Takarazuka; Haruo Yamashita, Ibaraki; Hideshi Ishihara, Katano, all of Japan

[73] Assignee: Matsushita Electric Industrial Co., Ltd., Kadoma, Japan

[21] Appl. No.: 835,019

[22] Filed: Apr. 8, 1997

Related U.S. Application Data

[62] Division of Ser. No. 160,032, Nov. 30, 1993, Pat. No. 5,644,351.

[30] Foreign Application Priority Data

Dec. 4, 1992 [JP] Japan ..... 4-324524
May 18, 1993 [JP] Japan ..... 5-115484

[51] Int. Cl.[6] ..... B41J 2/36; B41J 2/365

[52] U.S. Cl. ..... 347/194; 347/188; 347/189; 347/195; 347/196; 347/190

[58] Field of Search ..... 347/188, 189, 347/194, 195, 196, 190; 400/120.09, 120.1, 120.14, 120.15

[56] References Cited

U.S. PATENT DOCUMENTS

| | | | |
|---|---|---|---|
| 4,951,152 | 8/1990 | Suzuki et al. | 358/298 |
| 5,006,866 | 4/1991 | Someya | 346/76 PH |
| 5,066,961 | 11/1991 | Yamashita | 346/76 PH |
| 5,184,150 | 2/1993 | Sugimoto | 346/76 PH |
| 5,248,995 | 9/1993 | Izumi | 347/188 |

FOREIGN PATENT DOCUMENTS

| | | |
|---|---|---|
| 298456 | 4/1990 | Japan . |
| 2217267 | 8/1990 | Japan . |
| 2241760 | 9/1990 | Japan . |
| 2248264 | 10/1990 | Japan . |
| 2289364 | 11/1990 | Japan . |
| 324972 | 2/1991 | Japan . |
| 435961 | 2/1992 | Japan . |

OTHER PUBLICATIONS

Yamashita et al., The Journal of the Institute of Image Electronics Engineers of Japan, vol. 22, No. 1, pp. 20–26, "Density Compensating Method to Compensate Dynamic Heat Accumulations for Dye Transfer Printing."

*Primary Examiner*—Huan H. Tran
*Attorney, Agent, or Firm*—Renner, Otto, Boisselle & Sklar, P.L.L.

[57] ABSTRACT

In the disclosed thermal gradation printing apparatus, heat elements in a line-type thermal head are divided into a plurality of groups, and an accumulated heat amount in the substrate of the thermal head for each group is estimated based on the pulse width data applied to each heat element considering the influences by heat accumulations in the main-scanning direction and in the sub-scanning direction. Based on the group division estimated accumulated heat amounts and the temperature of the body portion of the thermal head, a correction value for the pulse width data to be applied to each heat element. Moreover, the correction value is applied to the pulse width data for each heat element, so as to output the corrected pulse width data to the thermal head.

2 Claims, 17 Drawing Sheets

THERMAL GRADATION PRINTING APPARATUS

This is a division of copending application Ser. No. 08/160,032, filed Nov. 30, 1993 now U.S. Pat. No. 5,644, 351.

BACKGROUND OF THE INVENTION

1. Field of the Invention

The present invention relates to a density level compensation for thermal disturbance for stably reproducing density in a printing apparatus for a multi-gradation image of high definition such as a television screen of the NTSC system, a computer graphics (CG), or a high definition television by using a thermal head.

2. Description of the Related Art

Recently, a thermal printing method for performing thermal printing by using a thermosensible printing paper or a thermal transfer film is superior to an ink-jet method and an electrophotographic method, because color printing can be easily realized and the apparatus size can be minimized by the thermal printing method. Moreover, the thermal printing method is advantageous in the image quality, the cost, and the maintenance of the apparatus. For the above reasons, the thermal printing method is widely applied to a hard copy apparatus for printing a photograph-like image.

In general, in a color printer utilizing a thermal gradation printing method, a line thermal head in which heat-elements are arranged in a line, and an ink sheet which is divisionally colored in yellow (Y), magenta (M) and cyan (C) are used. For one color, the printing is performed in a line sequence. When the printing for one color is completed, the image receiving sheet is rewound and the printing for the next color is performed. In this way, the printings for three colors are performed in a face sequence. In order to print a photograph-like image, a sublimation dye thermal transfer printing method and a concentrated heating transfer printing method are superior both of which can maintain sufficient resolution and gray scale, can easily control printing density, and can perform smooth gradation printing.

However, both of the methods utilize a heating energy generated by energizing heat-elements in the thermal head, so that the printed density is influenced by thermal disturbances, such as ambient temperature variation and heat accumulations in the thermal head. As a result, it is difficult to always stably reproduce density. In order to stabilize the printed density, the control for driving the thermal head that considers the temperature dependency is performed. Such a control is referred to as a density level compensation for thermal disturbance. The density level compensation for thermal disturbance is a main factor which limits the improvement in image quality during the development of such a printer.

When the full color printing by the face sequence is considered, the density balance between colors are broken due to different ambient temperatures or different accumulated heat amounts for respective colors. This results in the change of chromaticity of the printed color, so that strict requirements are required for the density level compensation for thermal disturbance.

For solving the above problem, there has been proposed a gradation printer (U.S. Pat. No. 5,066,961) as a first conventional example. In such a printer, an average accumulated heat amount in the substrate in the thermal head is estimated, and the time period for supplying power to the thermal head is corrected in accordance with the temperature variation due to the heat accumulation of the thermal head, by using the temperature of the body portion in the thermal head and the average accumulated heat amount in the substrate. As a result, the density is stably reproduced.

As a second conventional example, a thermal printing apparatus (Japanese Laid-Open Patent Publication No. 2-248264) has been proposed. In this apparatus, the thermal resistance and the thermal time constant which determines the thermal history in the substrate of the thermal head are automatically set, and the temperatures of regions of the substrate corresponding to respective heat elements in the thermal head are estimated. Thus, the time period for supplying power to the thermal head is corrected, so that the density is stably reproduced.

As a third and a fourth examples, a heat accumulation correcting circuit for a thermal head (Japanese Laid-Open Patent Publication No. 2-289364) and a heat accumulation estimating circuit (Japanese Laid-Open Patent Publication No. 3-24972) have been proposed. In such circuits, the accumulated heat amount along the main-scanning direction in the thermal head is obtained for each heat element for each 1-line printing period.

In a thermal head of a thin film type which is generally used, there exist three types of heat accumulations, i.e., a first heat accumulation in the body portion mainly caused by the thermal capacitance of the body portion and the heat dissipation to the air, a second heat accumulation in the substrate, and a third heat accumulation in a heat element, which respectively have time constants largely different from each other by about several minutes, several seconds or several milliseconds.

For the density level compensation for thermal disturbance in the gradation printing, it is required that the density correction accuracy be improved to a level corresponding to the gradation steps, so that the density of each gradation step can be accurately reproduced at any ambient temperature.

A thermal transfer printer or the like which is currently called a video printer makes a hard copy of an NTSC video image having a relative small image size to be printed (e.g., the A6 size). In such a printer, most of the input images are natural images having relatively averaged density distribution, and the line thermal head is short. Accordingly, such a printer has little degradation in the image quality due to the influence of the heat accumulation in the main-scanning direction. For this reason, as in the first conventional example, the density level compensation for thermal disturbance is performed based on the variation in ambient temperature, and an averaged accumulated heat amount in the main-scanning direction in the thermal head.

However, when an image with a greatly higher resolution than the NTSC video image, such as a high definition video image is to be printed, the gradation reproducibility and color reproducibility with higher accuracy are required. In the printing of an image having drastic density changes along the main-scanning direction (for example, an image having drastic density changes along the main-scanning direction as well as the sub-scanning direction, such as a computer graphic image), the accumulated heat amount is not uniform along a longitudinal direction of the thermal head (i.e., along the main-scanning direction of the image). As a result, the influence by such non-uniform accumulated heat amount may reach a level which cannot be negligible.

Moreover, with the development in office automation, it is essential to use a thermal head capable of printing an image having the size of A4 or more. Such a thermal head is longer than a thermal head used in a video printer. For the density level compensation for thermal disturbance in the first conventional example, the accumulated heat amount in the substrate is represented by an average value along the main-scanning direction. In the second conventional example, the heat accumulation in the substrate and the cooling of the substrate are considered for each heat element. However, the second conventional example does not consider the heat accumulation and the cooling along the longitudinal direction of the thermal head such as the heat inflow and diffusion caused by the heat generation by the adjacent heat elements. Therefore, when an image having drastic density changes along the main-scanning direction is to be printed by a hard copy for a larger image with higher quality, the variation in printed density cannot be sufficiently corrected by the first and second conventional examples. In some cases, there may occur overcompensation which deteriorates the image quality.

The third and fourth conventional examples have the following problems. It is difficult to actually measure the accumulated heat amount for each heat element in the main-scanning direction, and a method for correcting an applied energy by using the accumulated heat amount in the main-scanning direction is not established. Therefore, the correction of the applied energy is performed by using the correction value which is determined on the basis of a lot of data obtained by experiments, simulations, etc. However, the correction value thus determined can be used only under the corresponding printing conditions. Therefore, a correction value for the other printing conditions should be determined based on experiences or trials. Thus, it is extremely difficult to accurately reproduce the density of all gradation levels in the third and fourth conventional examples.

Furthermore, none of the above conventional examples, the third heat accumulation in heat elements which have a relatively little influence on the printed density during the low-speed printing is not considered. Therefore, the conventional examples have a problem in that there may occur the deterioration in image quality such as dullness of image edges due to the third heat accumulation in heat elements when the high-speed and high-quality printing is to be performed.

In a gradation printer capable of printing a full-color image, at least 64 gradation levels (6 bits) are required. In most conventional cases, the number of gradation levels is 256 (8 bits), because the 8-bit data is mainly used as the input digital RGB data, and because human beings can recognize an image to be full-color if 256 gradation levels are provided for each color. Accordingly, it is necessary to set the pulse width data for setting a time period supplying a power to the thermal head to be at least 8-bit data. If the pulse width data for setting a time period supplying the power to the thermal head is limited to 8-bit data, it is impossible to realize the correction accuracy higher than $1/256$ determined by the 8-bit data. By increasing the number of bits of the corrected pulse width data and the correcting coefficient from 8 bits, it is possible to improve the correction accuracy. However, it is necessary to drive the thermal head in accordance with the pulse width data for the same time period, even if the number of bits is increased. Accordingly, for every increase by one bit in the data transfer to the thermal head, substantially the double processing speed is required. Such a higher processing speed results in a larger increase in the circuit scale, or the like. As described above, the correction accuracy is in conflict with the circuit scale necessary for the data transfer to the thermal head.

SUMMARY OF THE INVENTION

The thermal gradation printing apparatus of this invention includes: a thermal head including a body portion, a substrate formed on the body portion, and a plurality of heat elements arranged in a line on the substrate, the plurality of heat elements being divided into a plurality of groups; head temperature detecting means for detecting the temperature of the body portion; data generating means for generating a plurality of data units each having a pulse width depending on density data, the pulse width indicating a time period for which a predetermined voltage is applied to one of the plurality of heat elements; group division accumulated heat amount estimating means for estimating accumulated heat amounts of regions of the substrate for every one line, the regions corresponding to the plurality of groups, respectively; correction value calculating means for calculating correction values assigned to the plurality of groups, respectively, based on the estimated accumulated heat amounts for the respective groups, and the temperature of the body portion; pulse width correcting means for correcting the pulse width of each of the plurality of data units based on the correction values, and for generating a plurality of corrected data units each having the corrected pulse width; and head driving means for applying the predetermined voltage to the plurality of heat elements for a time period in accordance with the plurality of corrected data units, wherein the group division accumulated heat amount estimating means estimates the accumulated heat amounts of regions corresponding to the plurality of groups, respectively, based on an average of the plurality of corrected data units generated for an immediately preceding line in each of the plurality of groups, and the accumulated heat amount of each of the plurality of groups in the immediately preceding line.

According to another aspect of the invention, a thermal gradation printing apparatus includes: a thermal head including a body portion, a substrate formed on the body portion, and a plurality of heat elements arranged in a line on the substrate, the plurality of heat elements being divided into a plurality of groups; head temperature detecting means for detecting the temperature of the body portion; data generating means for generating a plurality of data units each having a pulse width depending on density data, the pulse width indicating a time period for which a predetermined voltage is applied to one of the plurality of heat elements; group division accumulated heat amount estimating means for estimating accumulated heat amounts of regions of the substrate corresponding to the plurality of groups for every one line respectively, and for converting the estimated accumulated heat amounts to accumulated heat amounts of regions of the substrate corresponding to the plurality of heat elements, respectively; correction value calculating means for calculating correction values assigned to the plurality of heat elements, respectively, based on the converted accumulated heat amounts, and the temperature of the body portion; pulse width correcting means for correcting the pulse width of each of the plurality of data units based on the correction values, and for generating a plurality of corrected data units each having the corrected pulse width; and head driving means for applying the predetermined voltage to the plurality of heat elements for a time period in accordance with the plurality of corrected data units, wherein the group division accumulated heat amount estimating means estimates the accumulated heat amounts of regions corresponding to the plurality of groups, respectively, based on an average of the plurality of corrected data units generated for an immediately preceding line in each of the plurality of groups, and the accumulated heat amount of each of the plurality of groups in the immediately preceding line.

According to another aspect of the invention, a thermal gradation printing apparatus includes: a thermal head including a body portion, a substrate formed on the body portion, and a plurality of heat elements arranged in a line on the substrate, the plurality of heat elements being divided into a plurality of groups; head temperature detecting means for detecting the temperature of the body portion; data generating means for generating a plurality of data units each having a pulse width depending on density data, the pulse width indicating a time period for which a predetermined voltage is applied to one of the plurality of heat elements; group division accumulated heat amount estimating means for estimating accumulated heat amounts of regions of the substrate for every one line, the regions corresponding to the plurality of groups, respectively; correction value calculating means for calculating correction values assigned to the plurality of heat elements, respectively, based on the estimated accumulated heat amounts for the respective groups, and the temperature of the body portion; pulse width correcting means for correcting the pulse width of each of the plurality of data units based on the correction values, and for generating a plurality of corrected data units each having the corrected pulse width; and head driving means for applying the predetermined voltage to the plurality of heat elements for a time period in accordance with the plurality of corrected data units, wherein the group division accumulated heat amount estimating means estimates the accumulated heat amounts of regions corresponding to the plurality of groups, respectively, based on an average of the plurality of corrected data units generated for an immediately preceding line in each of the plurality of groups, and the accumulated heat amount of each of the plurality of groups in the immediately preceding line.

In one embodiment of the invention, the group division accumulated heat amount estimating means includes interpolating means for interpolating the estimated accumulated heat amounts into the accumulated heat amounts of the regions of the substrate corresponding to the plurality of heat elements, respectively.

In another embodiment of the invention, the correction value calculating means includes interpolating means for calculating correction values assigned to the plurality of groups, respectively, based on the estimated accumulated heat amounts and the temperature of the body portion, and for interpolating the calculated correction values into correction values corresponding to the plurality of heat elements, respectively.

In another embodiment of the invention, the group division accumulated heat amount estimating means estimates an accumulated heat amount for a center one of three successive groups in the plurality of groups by using a recurrence formula, the recurrence formula being determined by accumulated heat amounts in the immediately preceding line estimated for the three successive groups and values corresponding to the center group among the plurality of corrected data units for the immediately preceding line.

In another embodiment of the invention, the thermal gradation printing apparatus further includes virtual heat-element groups which are provided to sandwich the line formed by the plurality of heat elements, wherein, when the center group of the three successive groups is positioned at an end of the line, the group division accumulated heat amount estimating means estimates the accumulated heat amount of the center group by using an accumulated heat amount estimated for corresponding one of the virtual heat-element groups in the immediately preceding line.

In another embodiment of the invention, the thermal gradation printing apparatus further includes second pulse width correcting means for calculating a difference between the plurality of corrected data units generated for the current line by the pulse width correcting means and a plurality of corrected data units generated for the immediately preceding line, for multiplying the difference by a predetermined coefficient, the predetermined coefficient being determined by a thermal time constant of each of the plurality of heat elements, and for adding the multiplied result to the corrected data units for the current line, whereby the corrected data units for a current line are further corrected.

In another embodiment of the invention, the correction value is represented by n bits, and wherein the pulse width correcting means includes: comparing means for comparing a value represented by lower m bits of the correction value with a reference value, and for generating an output value, the output value having one of a first value when the value represented by the lower m bits is larger than the reference value and a second value when the value represented by the lower m bits is equal to or smaller than the reference value; reference value setting means for setting the reference value for each line; adding means for adding the output value from the comparing means to a value represented by upper (n-m) bits of the correction value, to generate a sum; and multiplying means for multiplying the sum by the plurality of data units generated by the data generating means, the reference value setting means setting different values for $2^m$ lines, respectively.

In another embodiment of the invention, the correction value is represented by n bits, and wherein the pulse width correcting means includes: comparing means for comparing a value represented by lower m bits of the correction value with a reference value, and for generating an output value, the output value having one of a first value when the value represented by the lower m bits is larger than the reference value and a second value when the value represented by the lower m bits is equal to or smaller than the reference value; reference value setting means for setting the reference value for each line; and adding means for adding the output value from the comparing means, a value represented by upper (n-m) bits of the correction value, and the plurality of data units generated by the data generating means to each other, the reference value setting means setting different values for $2^m$ lines, respectively.

According to another aspect of the invention, a thermal gradation printing apparatus includes: a thermal head including a body portion, a substrate formed on the body portion, and a plurality of heat elements arranged in a line on the substrate; head temperature detecting means for detecting the temperature of the body portion; data generating means for generating a plurality of data units depending on density data units; accumulated heat amount estimating means for estimating accumulated heat amounts of regions of the substrate for every one line, the regions corresponding to the plurality of heat elements, respectively; correction value calculating means for calculating correction values assigned to the plurality of heat elements, respectively, based on the estimated accumulated heat amounts, and the temperature of the body portion; data correcting means for correcting the plurality of data units based on the correction values; and head driving means for allowing the plurality of heat elements to heat in accordance with the corrected data units, wherein the correction value is represented by n bits, and wherein the data correcting means includes: comparing means for comparing a value represented by lower m bits of the correction value with a reference value, and for generating an output value, the output value having one of a first value when the value represented by the lower m bits is larger than the reference value and a second value when the value represented by the lower m bits is equal to or smaller than the reference value; reference value setting means for setting the reference value for each line; adding means for adding the output value from the comparing means to a value represented by upper (n-m) bits of the correction value, to generate a sum; and multiplying means for multiplying the sum by the plurality of data units generated by the data generating means, the reference value setting means setting different values for $2^m$ lines, respectively.

According to another aspect of the invention, a thermal gradation printing apparatus includes: a thermal head including a body portion, a substrate formed on the body portion, and a plurality of heat elements arranged in a line on the substrate; head temperature detecting means for detecting the temperature of the body portion; data generating means for generating a plurality of data units depending on density data units; accumulated heat amount estimating means for estimating accumulated heat amounts of regions of the substrate for every one line, the regions corresponding to the plurality of heat elements, respectively; correction value calculating means for calculating correction values assigned to the plurality of heat elements, respectively, based on the estimated accumulated heat amounts, and the temperature of the body portion; data correcting means for correcting the plurality of data units based on the correction values; and head driving means for allowing the plurality of heat elements to heat in accordance with the corrected data units, wherein the correction value is represented by n bits, and wherein the data correcting means includes: comparing means for comparing a value represented by lower m bits of the correction value with a reference value, and for generating an output value, the output value having one of a first value when the value represented by the lower m bits is larger than the reference value and a second value when the value represented by the lower m bits is equal to or smaller than the reference value; reference value setting means for setting the reference value for each line; and adding means for adding the output value from the comparing means, a value represented by upper (n-m) bits of the correction value, and the plurality of data units generated by the data generating means to each other, the reference value setting means setting different values for $2^m$ lines, respectively.

Thus, the invention described herein makes possible the advantages of (1) providing a thermal gradation printing apparatus which can accurately correct the variation of printed density due to the variation in the ambient temperature and the heat accumulation in the thermal head itself for an image having drastic density changes along the main-scanning direction, and which can accurately reproduce the density of all gradation levels considering the third heat accumulation in heat elements and improving the image quality deterioration such as dullness of image edges due to the third heat accumulation during the high-speed printing, and (2) providing a thermal gradation printing apparatus in which the correction accuracy for the pulse width data during the density level compensation for thermal disturbance can be improved without causing a large increase in circuit scale as the result of the increase in data transfer speed to the thermal head.

These and other advantages of the present invention will become apparent to those skilled in the art upon reading and understanding the following detailed description with reference to the accompanying figures.

DESCRIPTION OF THE PREFERRED EMBODIMENTS

A first example of the invention will be described with reference to relevant figures.

Figure 1:
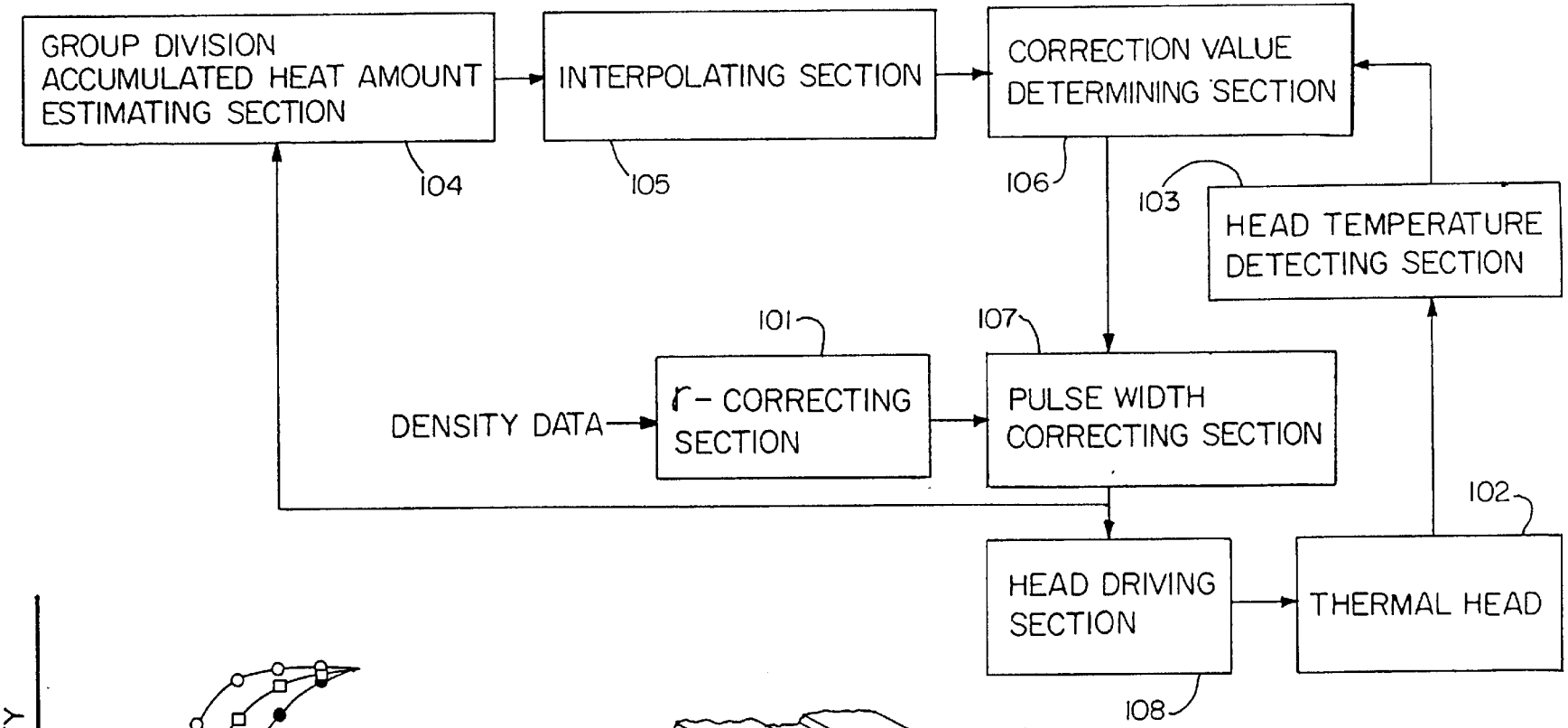
FIG. 1 shows a construction of a thermal gradation printing apparatus of a first example according to the invention.

FIG. 1 shows a construction of a thermal gradation printing apparatus of the first example according to the invention for performing printing by a pulse width control for the purpose of accurately reproducing density for the input density data in view of influences by an ambient temperature and heat accumulation in a thermal head.

In FIG. 1, the thermal gradation printing apparatus of the first example includes a γ-correcting section 101, a thermal head 102, a head temperature detecting section 103, a group division accumulated heat amount estimating section 104, an interpolating section 105, a correction value determining section 106, a pulse width correcting section 107, and a head driving section 108. The γ-correcting section 101 converts input density data to be printed into pulse width data, and outputs the pulse width data. In the thermal head 102, a number of heat elements are arranged in a line. The head temperature detecting section 103 detects a temperature of the body portion of the thermal head 102. The group division accumulated heat amount estimating section 104 divides the large number of heat elements into a plurality of groups, and estimates an accumulated heat amount in a region of a substrate corresponding to each of the groups of the heat elements of the thermal head 102. The interpolating section 105 interpolates the estimated accumulated heat amount for each group which is an output of the group division accumulated heat amount estimating section 104 into an estimated accumulated heat amount corresponding to each heat element. The correction value detecting section 106 determines a correction value which is assigned to each heat element based on the output of the head temperature detecting section 103 and the output of the interpolating section 105. The pulse width correcting section 107 applies the correction value determined by the correction value determining section 106 to the pulse width data output from the γ-correcting section 101, so as to correct the pulse width data to obtain corrected pulse width data. The thermal head driving section 108 drives the thermal head 102 based on the corrected pulse width data output from the pulse width correcting section 107. Specifically, a predetermined voltage is applied to each heat element on the thermal head 102 for a time period determined based on the corrected pulse width data.

Figure 2:
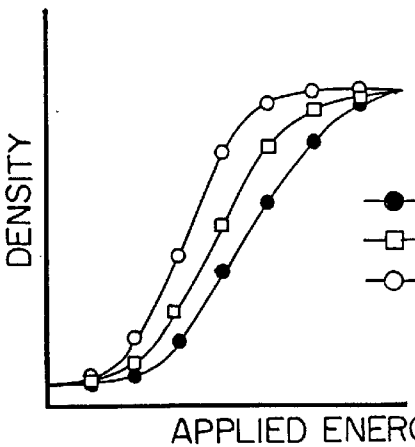
FIG. 2 shows a non-linear relationship between an applied energy and printed density, which is called as a γ-characteristic.

In the thermal transfer printing or the thermal printing, as is shown in FIG. 2, the applied energy and the printed density have a non-linear relationship which is called the γ-characteristic. In order to obtain accurate density gradation, it is necessary to appropriately regulate the energy to be applied considering the γ-characteristic. Such regulation, i.e., the γ-correction is performed by the γ-correcting section 101. The γ-correcting section 101 in this example is realized by a ROM table in which a set of pulse width data is written. The set of pulse width data is required for reproducing density corresponding to the input density data for a reference body portion temperature and a reference accumulated heat amount in the substrate. Specifically, when density data is given to the address of the ROM, a pulse width data required for reproducing the density is read out.

The group division accumulated heat amount estimating section 104 estimates an accumulated heat amount in the substrate of the thermal head 102 in each of the plurality of groups, based on the corrected pulse width data supplied from the pulse width correcting section 107 to each heat element of the thermal head 102. The correction value determining section 106 calculates the correction value. The correction value is used for correcting the pulse width data output from the γ-correcting section 101 for a reference body portion temperature and a reference accumulated heat amount in the substrate, to obtain pulse width data in accordance with the actual temperature and the actual accumulated heat amount in the substrate. The calculation is performed, based on the interpolated and estimated accumulated heat amount in the substrate for each heat element output from the interpolating section 105 and the body portion temperature detected by the head temperature detecting section 103. The corrected pulse width data monotonously decreases with the increase in the head temperature and the accumulated heat amount. The pulse width correcting section 107 applies the correction value from the correction value determining section 106 to the pulse width data output from the γ-correcting section 101, so as to output the corrected pulse width data with density level compensation for thermal disturbance to each heat element.

Next, a method for determining a correction value is described.

Figure 3:
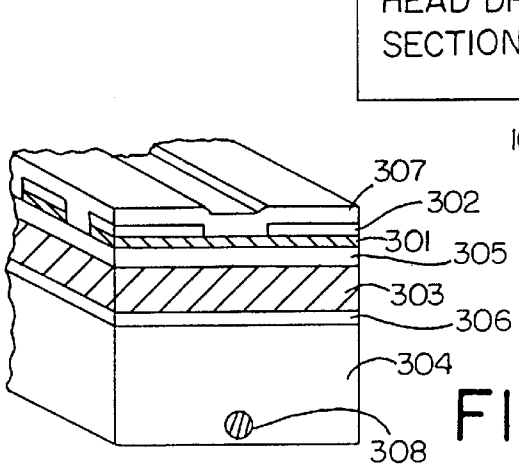
FIG. 3 is a cross-sectional view showing a thermal head 102 in the thermal gradation printing apparatus of the first example according to the invention

FIG. 3 is a cross-sectional view of the thermal head 102 substantially at the center thereof along the main-scanning direction. As is shown in FIG. 3, the thermal head 102 includes a heat element 301, an electrode 302 for allowing a current to flow through the heat element 301, a substrate 303 made of ceramic, a body portion 304 made of aluminum, a glaze layer 305, an adhesive layer 306, a protective layer 307, and a thermistor 308 for measuring a temperature of the body portion 304.

Figure 4:
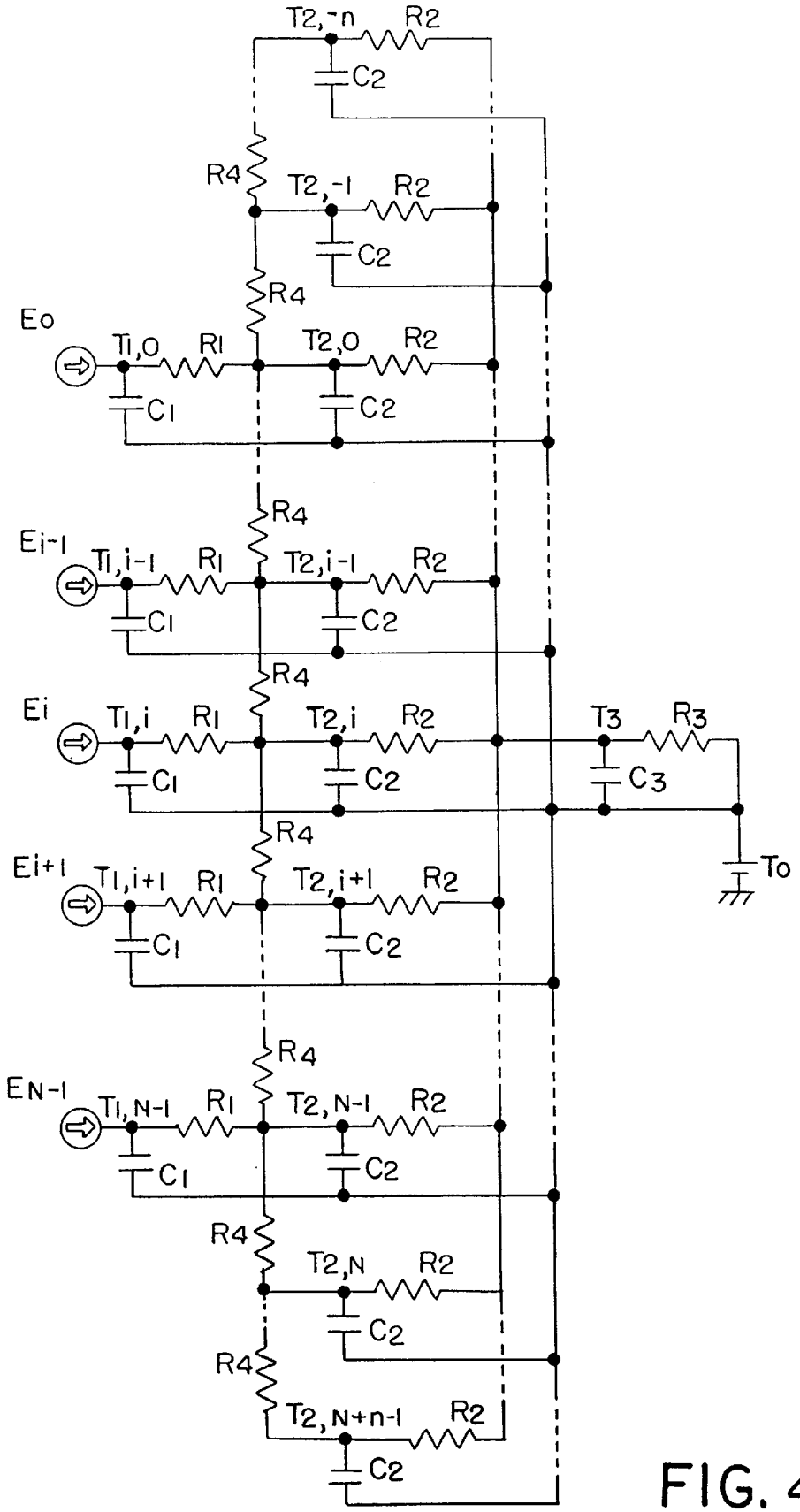
FIG. 4 is a diagram showing a thermally equivalent network model in the thermal head.

In order to clarify temperatures of various portions of the thermal head 102 shown in FIG. 3, the thermal propagation in the thermal head 102 is modeled as a thermally equivalent network. The equivalent network model is shown in FIG. 4. The thermally equivalent network is modeled based on the approximation in view of the thermal resistance and the thermal capacitance of the thermal head 102. The electrical resistance indicates a thermal resistance, the electrical capacitance indicates a thermal capacitance, the voltage indicates a temperature, and the current indicates an energy per unit time.

In FIG. 4, the electric capacitances $C_1$, $C_2$, and $C_3$ correspond to the thermal capacitances for the heat element 301, for the substrate 303, and for the body portion 304, respectively. The electric resistance $R_1$ corresponds to the thermal resistance between the heat element 301 and the substrate 303 with the glaze layer 305 interposed therebetween, the electric resistance $R_2$ corresponds to the thermal resistance between the substrate 303 and the body portion 304, the electric resistance $R_3$ corresponds to the thermal resistance between the body portion 304 and the ambient air (including a heat dissipation plate or the like), and the electric resistance $R_4$ corresponds to the thermal resistance in the substrate 303 along the main-scanning direction. $E_0$–$E_{N-1}$ denote energies (electric powers) applied to respective heat elements per unit time. $T_0$ denotes an ambient temperature such as a temperature of an ambient air, $T_{1,0}$–$T_{1,N-1}$ denote temperatures of respective heat elements, $T_{2,-n}$–$T_{2,N+n-1}$ denote temperatures of the substrate, and $T_3$ denotes the temperature of the body portion.

Figure 5:
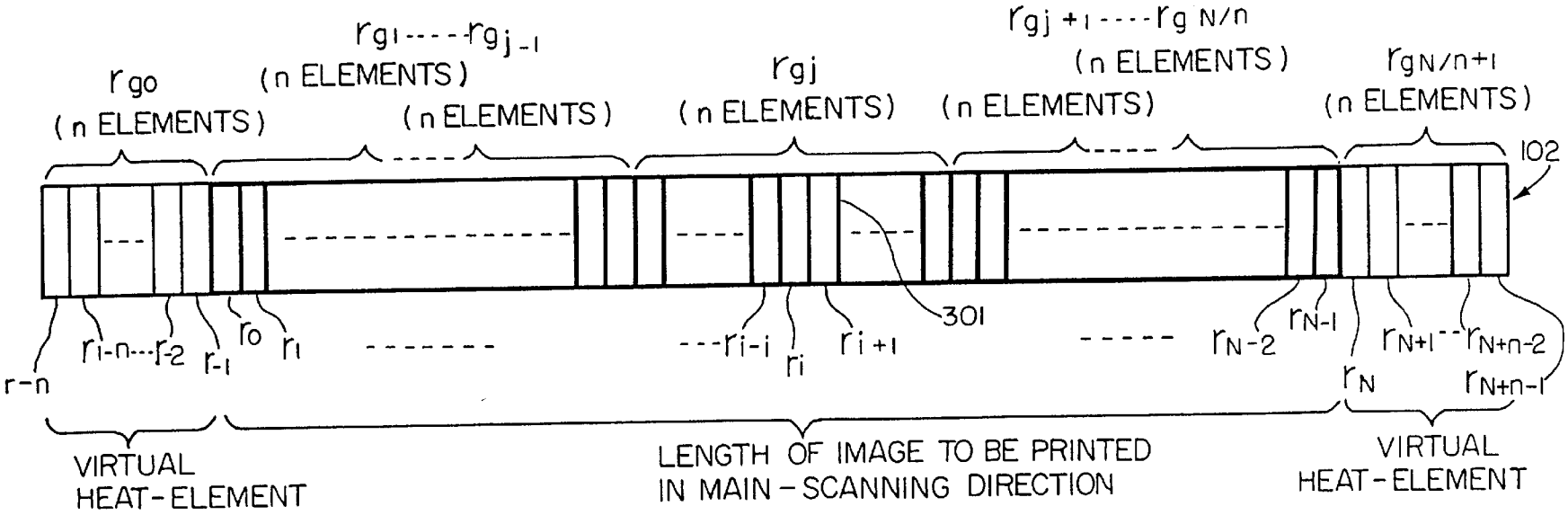
FIG. 5 shows a group division in the thermal head.

The group division in the thermal head 102 is shown in FIG. 5. In FIG. 5, N heat elements 301 are included in the thermal head 102, and the N heat elements 301 are represented by $r_0$–$r_{N-1}$ (N is an integer). The N heat elements are arranged in a line. The line of the heat elements corresponds to the length of an image to be printed in the main-scanning direction. On the left and right sides of the heat elements $r_0$ and $r_{N-1}$ which are positioned at both ends of a row of the heat elements 301, n virtual heat elements ($r_{-n}$–$r_{-1}$ and $r_N$–$r_{N+n-1}$) are arranged, respectively. These heat elements ($r_{-n}$–$r_{N+n-1}$) are divided into a plurality of groups $rg_0$–$rg_{N/n+1}$ (n indicates the number of heat elements included in one group). The groups $rg_0$ and $rg_{N/n+1}$ each include the n virtual heat elements which do not contribute to the printing.

The substrate 303 is longer than the length of the image to be printed in the main-scanning direction. If the influence by the heat propagation into a portion of the substrate 303 corresponding to a difference between the length of the substrate 303 and the length of the image to be printed in the main-scanning direction is considered, good correction can be performed. The n virtual heat elements on each of the sides of the thermal head 102 do not generate heat. Therefore, in the thermally equivalent network model shown in FIG. 4, the thermal capacitance $C_1$ and the thermal resistance $R_1$ are not connected to the thermal capacitance $C_2$ for the group including n virtual heat elements.

Figure 6:
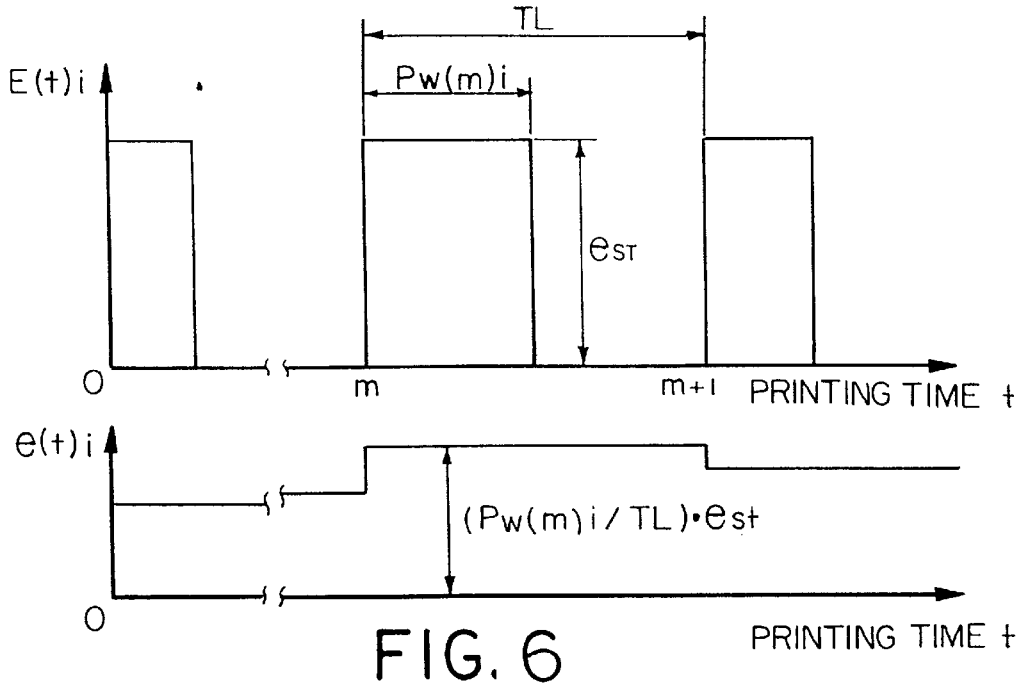
FIG. 6 shows an applied energy per unit time for each heat-element.

Hereinafter, by using the equivalent network model shown in FIG. 4, the heat accumulation in the thermal head 102 is analyzed. As is shown in FIG. 6, the applied energy per unit time $E(t)_i$ as input data corresponding to each pixel is a rectangular wave having the amplitude of $e_{ST}$ and the pulse width data $Pw(m)_i$ for the mth line for reproducing the desired density in one line printing period TL. The thermal time constant $C_2R_2$ of the substrate 303 and the one line printing period TL have a relationship of $TL \ll C_2R_2$. The thermal time constant $C_1R_1$ of the heat element 301 and the period TL have a relationship of $TL \gg C_1R_1$. Accordingly, when the behavior of the heat is analyzed after the heat is transmitted to the substrate 302, the applied energy $E(t)_i$ can be regarded as a time average value $e(t)_i$ for each one line. The time average value $e(t)_i$ can be expressed by Expression (1), as is shown in FIG. 6.

$$e(t)_i=(Pw(m)_i/TL)\cdot e_{ST} \tag{1}$$

where m denotes the number of the printing lines and i denotes the heat element position along the main-scanning direction (i is an integer; i=0 to N−1).

The temperature rise amount $P(t)_i$ due to the heat accumulation in the substrate 303 is defined as expressed in Expression (2).

$$P(t)_i=T_2(t)_i-T_3(t)_i \tag{2}$$

where $T_2(t)_i$ is the substrate temperature, and $T_3(t)_i$ is the body portion temperature. The body portion temperature $T_3(t)_i$ has a very large thermal capacitance, and is substantially constant along the main-scanning direction, so that it can be set as in Expression (3).

$$T_3(t)_i=T_3(t) \tag{3}$$

Therefore, the current incoming and outgoing in the substrate 303 in the equivalent network model shown in FIG. 4 can be expressed by Expression (4).

$$\frac{Pw(m)_i}{TL}\cdot e_{ST}+\frac{P(t)_{i-1}-P(t)_i}{R_4}=\frac{P(t)_i-P(t)_{i+1}}{R_4}+\frac{P(t)_i}{R_2}+C_2\frac{dP(t)_i}{dt} \tag{4}$$

The body portion temperature $T_3(t)$ can be accurately measured every time when the printing of one line is performed, by the head temperature detecting section 103 using the thermistor 308 provided in the body portion 304. Accordingly, in view of the accuracy, it is desirable that the substrate temperature $T_2(t)_i$ be estimated by using the body portion temperature $T_3(t)$ actually measured by the head temperature detecting section 103 in addition to the initial value of each temperature and the supplied power $e(t)_i$.

Expression (5) is obtained considering the actual printing operation, by making Expression (4) temporally discrete for each line period, and by making Expression (4) positionally discrete.

$$Pg(m)_j=\left(1-\frac{TL}{C_2R_2}\right)Pg(m-1)_j+\frac{e_{ST}}{C_2}Pw(m-1)_j+\frac{TL}{n^2C_2R_4}(Pg(m-1)_{j+1}-2Pg(m-1)_j+Pg(m-1)_{j-1}) \tag{5}$$

where j denotes a group position (j is an integer; j=0 to N/n+1), and $Pw(m-1)_j$ is a value obtained by averaging the pulse width data $Pw(m-1)_i$ for respective heat elements in each group.

In Expression (5), $Pg(m)_j$ is an estimated accumulated heat amount for each group including n heat elements. The purpose of grouping the n heat elements is to suppress the divergence of Expression (5) so as to stabilize Expression (5). The condition for stabilizing Expression (5) is expressed by Expression (6).

$$\frac{1}{2}\geqq(TL/n^2C_2R_4)^{1/2}>0 \tag{6}$$

Accordingly, the number n of the heat elements in one group can be optimally selected by using Expression (6) on the basis of the one line printing period TL and the thermal time constant $C_2R_4$ of the substrate along the main-scanning direction.

As described above, it is possible to stably calculate the group division estimated accumulated heat amount $Pg(m)_j$ by only one operation for one line, by Expression (5). The group division estimated accumulated heat amount $Pg(m)_j$ shown in Expression (5) means that the accumulated heat amount in the substrate of the center one of successive three groups is determined by the accumulated heat amounts in the substrate of the above-specified successive three groups for the previous one line period TL, and the corrected pulse width data supplied to the heat elements in the center group.

That is, the estimated accumulated heat amount is determined considering not only the influence by the accumulated heat amounts in the substrate along the sub-scanning direction but also the influence by the accumulated heat amounts in the substrate along the main-scanning direction.

Then, the group division estimated accumulated heat amount $Pg(m)_j$ shown by Expression (5) is linearly interpolated into the accumulated heat amount for each heat element shown by Expression (7), and the interpolated accumulated heat amount is represented by $P(m)_i$.

$$P(m)_i = Pg(m)_j + \{Pg(m)_{j+1} - Pg(m)_j\} \cdot k/n \quad (7)$$

where i is an integer (i=0 to N−1), j is an integer of (i/n), and k is a remainder obtained by dividing i by n.

Next, the calculation of the correction value to be applied to the pulse width data output from the γ-correcting section 101 will be described. The correction value is calculated by using the interpolated accumulated heat amount $P(m)_i$ shown by Expression (7). Qualitatively, the correction value functions so as to decrease the pulse width data to be supplied to each heat element, when the body portion temperature rises, and the accumulated heat amount in the substrate is increased. According to the experiments conducted by the inventors of this invention, it was confirmed that a correction value obtained by using Expression (8-A) was suitable for the correction in the low-speed printing, and a correction value obtained by using Expression (8-B) was suitable for the correction in the high-speed printing.

$$K1(m)_i = \frac{A_1}{A_2 + T_3(m) + P(m)_i} \quad (8\text{-A})$$

$$K2(m)_i = A_3 \cdot (T_3(m) + P(m)_i) + A_4 \quad (8\text{-B})$$

where $A_1$, $A_2$, $A_3$, $A_4$ are constants determined for each thermal head, and T3(m) is the body portion temperature.

During the low-speed printing, the corrected pulse width data $Pw(m)_i$ to be output to the head driving section 108 is calculated by applying the correction values $K1(m)_i$ shown by Expression (8-A) to the pulse width data $Pwin(m)_i$ obtained by the γ-correcting section 101 on the basis of Expression (9-A).

$$Pw(m)_i = K1(m)_i \mathrm{Pwin}(m)_i \quad (9\text{-A})$$

During the high-speed printing, the corrected pulse width data $Pw(m)_i$ is calculated by applying the correction value $K2(m)_i$ shown by Expression (8-B) to the pulse width data $Pwin(m)_i$ on the basis of Expression (9-B).

$$Pw(m)_i = K2(m)_i + \mathrm{Pwin}(m)_i \quad (9\text{-B})$$

As described above, the correction value which is obtained considering the influence in the main-scanning direction by the heat accumulation as well as the influence in the sub-scanning direction can be represented by general equations. Accordingly, by obtaining the constants A1, A2, A3, and A4 which are inherent to the thermal head, various types of images and driving conditions can be flexibly accommodated. If the thermal head 102 is driven based on the corrected pulse width data $Pw(m)_i$ obtained by using Expression (9-A) or (9-B), various densities in the whole density range can be respectively kept constant without being affected by the ambient temperature during the printing, the heat accumulation of the body portion, and the type of the image to be printed.

Figure 7:
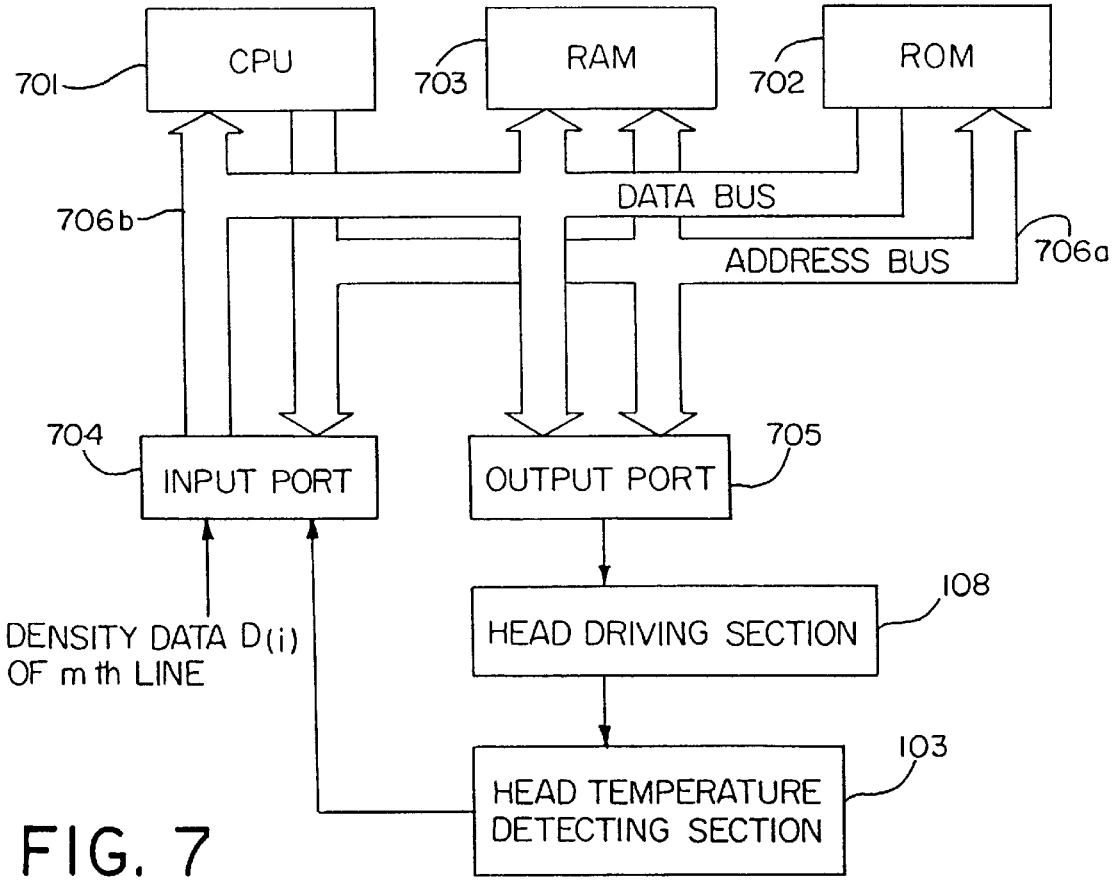
FIG. 7 is a circuit block diagram of an embodiment in the first, second, third, and fourth examples of the invention.

FIG. 7 is a circuit block diagram showing an embodiment of the construction shown in FIG. 1. As is shown in FIG. 7, the construction includes a CPU 701, a ROM 702 for storing programs for the CPU 701, constants and the like, a RAM 703 used as a stack, variables, or a work area, an input port 704 for inputting density data depending on the gradation to be printed for each pixel and a body portion temperature from the head temperature detecting section 103, an output port 705 for outputting corrected pulse width data to the head driving section 108, and 706*a* and 706*b* serving as address bus and data bus, respectively. In the ROM 702, in addition to the programs for the CPU 701 and constants, the γ-correction table as the γ-correcting section 101 is previously stored.

Figure 8:
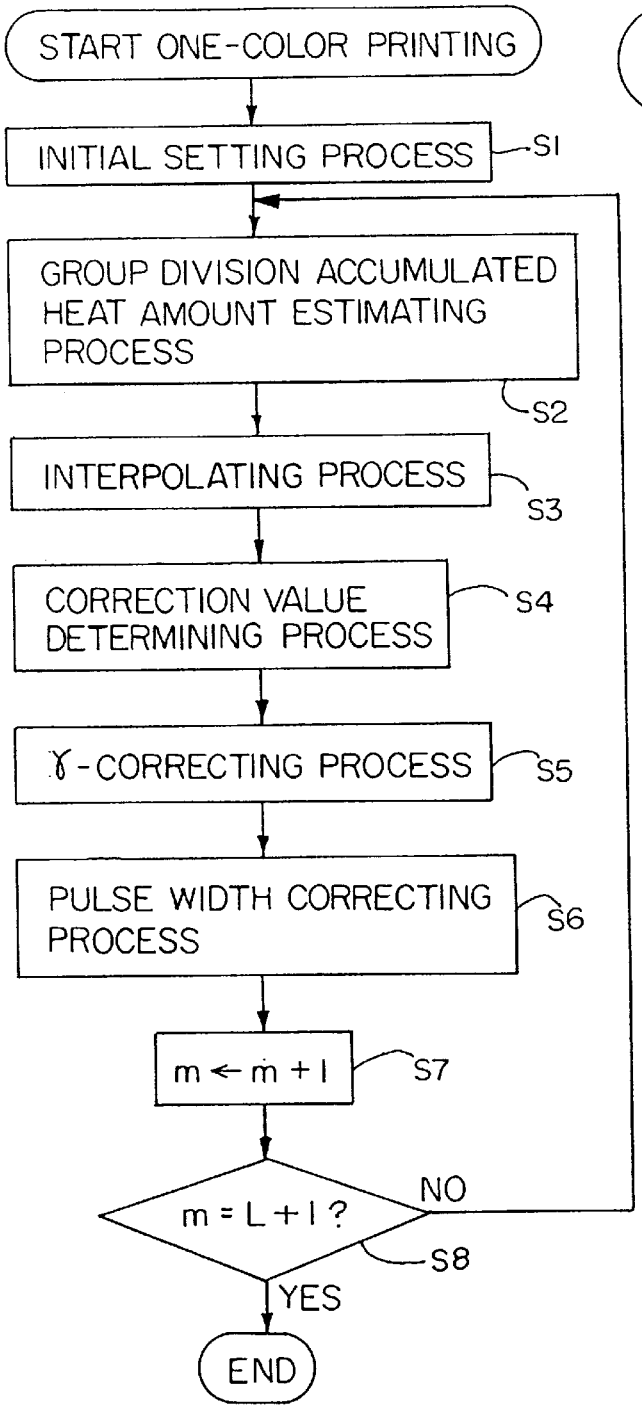
FIG. 8 is a flowchart illustrating a density level compensation for thermal disturbance in one embodiment of the first example of the invention, especially, during one color printing.

The thermal gradation printing apparatus of this example prints an image on an image receiving sheet with three colors by using an ink sheet colored in yellow (Y), magenta (M), and cyan (C) which is not shown. The thermal gradation printing apparatus of this example performs the printing for one color in a line sequence manner by driving the thermal head 102. When the printing for one color is completed, the image receiving sheet is rewound, and the printing for the next color is performed in the same way on the face which has an image formed by the above one-color printing. Thus, the printing for three colors is performed in a face sequence manner. As is understood from the above description, the operations of the face-sequence printings for three colors are identical to each other. Accordingly, FIG. 8 is a flowchart regarding the density compensating operation for thermal disturbance during one-color printing of the embodiment shown in FIG. 7. FIGS. 9 to 14 specifically show the subroutines of the processes, respectively. Hereinafter, the density compensating operation for thermal disturbance for correcting the variation of the printed density due to the ambient temperature, the heat accumulation in the body portion, and the heat accumulation in the substrate is described in detail, with reference to FIGS. 1 and 8 to 14. In the density compensating operation for thermal disturbance, the above-described expressions which are required for the density level compensation for thermal disturbance are used.

Figure 9:
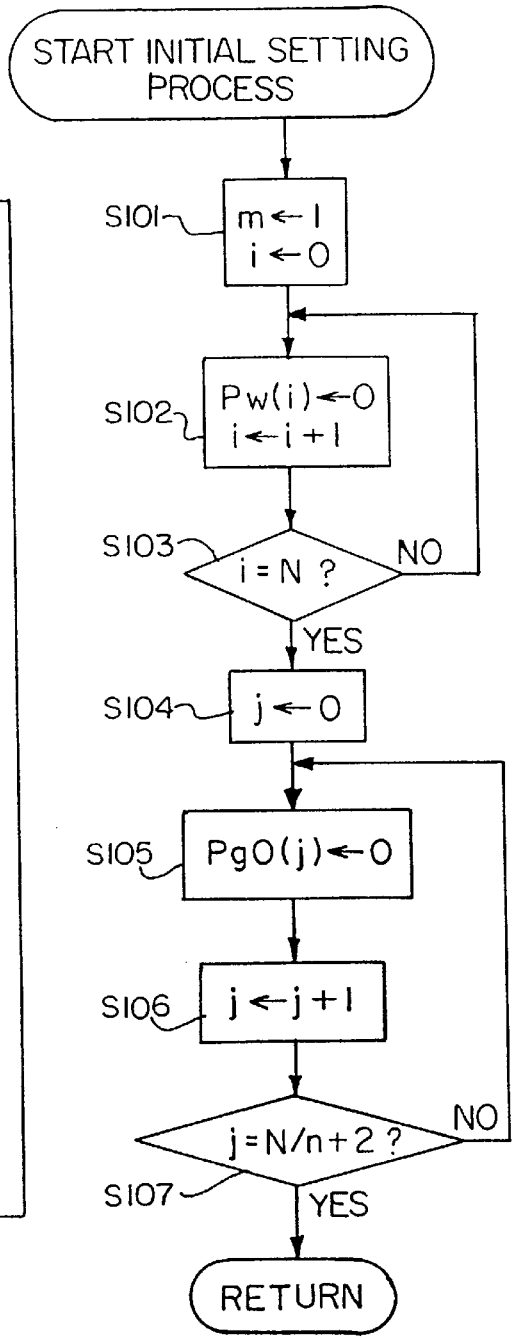
FIG. 9 shows a sub routine of the initial setting operation S1 in FIG. 8.

In FIG. 8, an initial setting process S1 is performed for the first color. As is shown in FIG. 9, in the initial setting process S1, for the printing for the first line, a variable m for counting the number of lines is initialized to be 1, and the corrected pulse width data Pw(i) for ith heat element and the accumulated heat amount Pg0(j) for jth group of heat elements in the substrate are set to be 0 (S101–S107), where i is a variable for sequentially counting heat elements, and j is a variable for sequentially counting groups.

Figure 10:
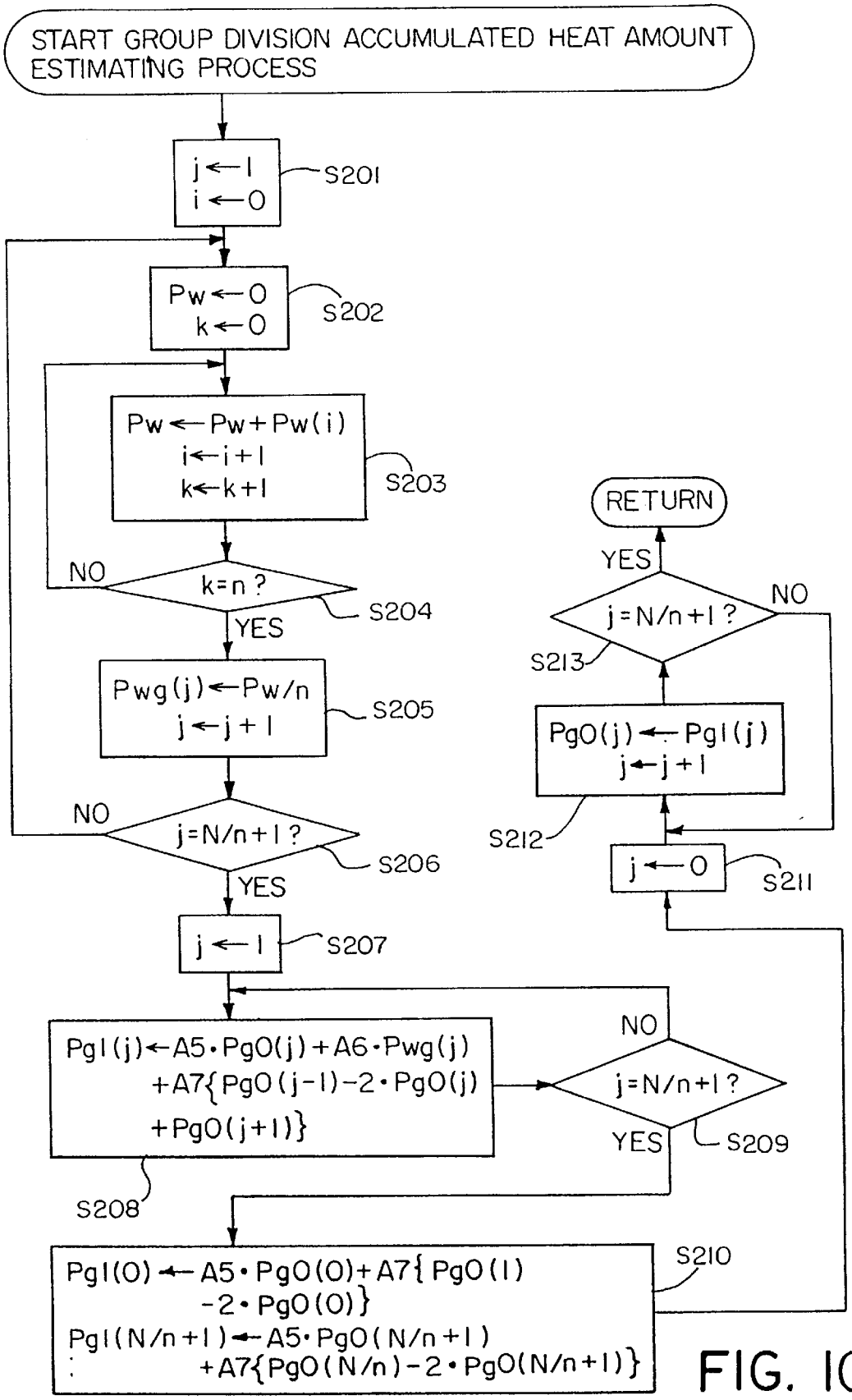
FIG. 10 shows a sub routine of the accumulated heat amount estimating operation for each group S2 in FIG. 8.

After the initial setting process S1 at the start of the printing is terminated, a group division accumulated heat amount estimating process S2 for estimating the accumulated heat amount for each group in the substrate is performed. As is shown in FIG. 10, in the process S2, the corrected pulse width data Pw(i) which were supplied to respective heat elements in the previous line are sequentially read out, and they are summed up for each of the groups $r_{g1}$–$r_{gN/n}$ excluding the end groups (the number of heat elements in one group is n), and then the summed result is divided by the number n of the heat elements in one group (S201–S206). That is an averaged pulse width data Pwg(j) is calculated for each of the groups $r_{g1}$–$r_{gN/n}$. Accordingly, if m=1, the corrected pulse width data Pw(i) which is set in the initial setting process S1 is summed up. Based on the average pulse width data Pwg(j) for each group $r_{g1}$–$r_{gN/n}$, the accumulated heat amount Pg1(j) in the substrate is derived for each group on the basis of Expression (5) (S207–S209). For the end groups $r_{g0}$ and $r_{gN/n+1}$, the estimated accumulated heat amounts Pg1(0) and Pg1(N/n+1) in the substrate are derived considering the following conditions (S210).

The heat elements in the end groups do not generate the heat and not contribute to the image printing. On the outer sides of the end groups, the substrate does not exist, so that there is no heat accumulation.

In S201–S210, the group division estimated accumulated heat amounts Pg1(j) for the current printing line are derived. In the calculation for the next line, the group division estimated accumulated heat amounts Pg1(j) for the current line are required. For this purpose, the contents of the group division estimated accumulated heat amounts Pg1(j) are transferred to the group division estimated accumulated heat amount Pg0(j), preparing for the calculation for the next line (S211–S213). The group division accumulated heat amount estimating section 104 is realized by the group division accumulated heat amount estimating process S2.

Figures 11, 12:
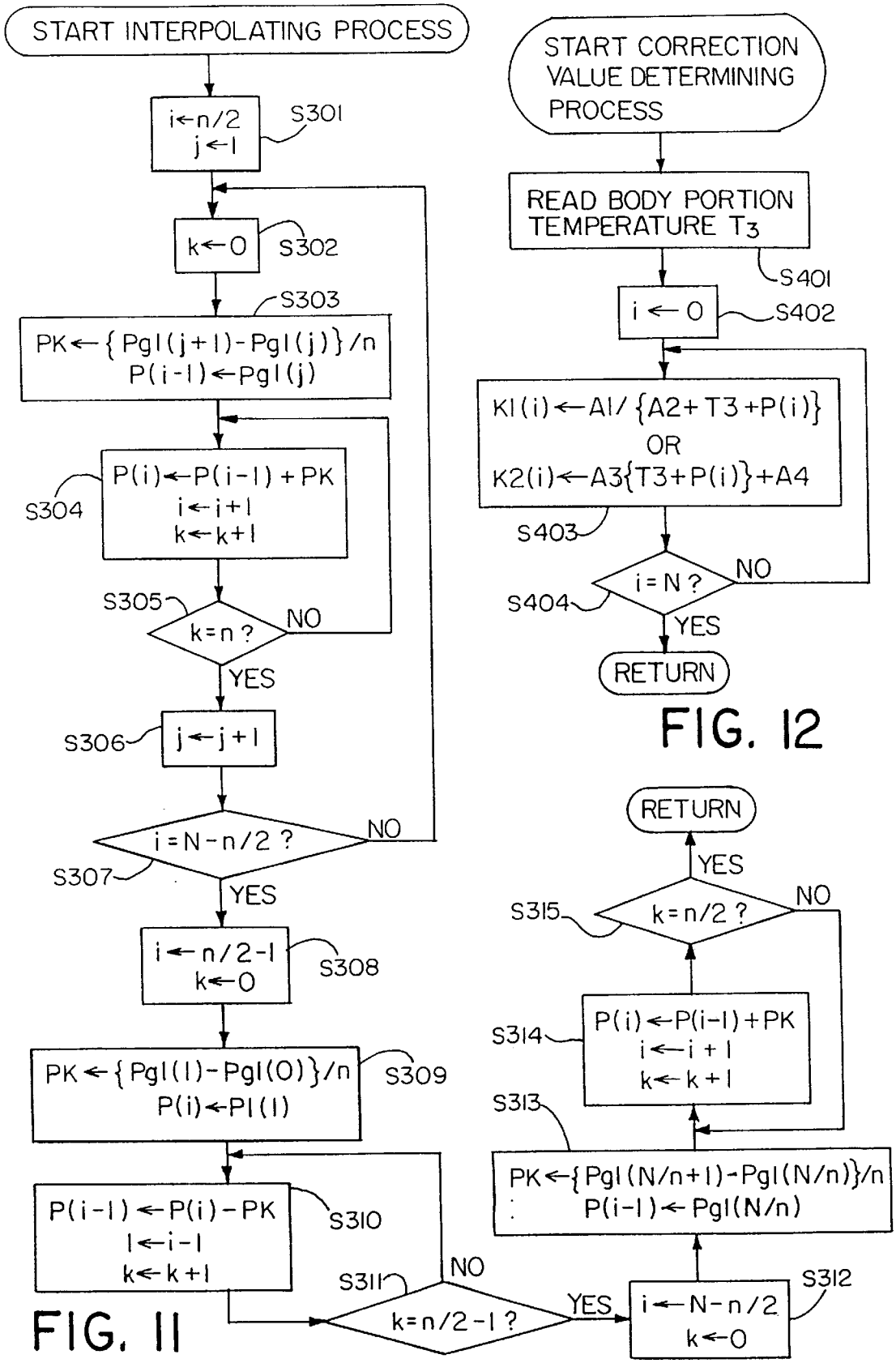
FIG. 11 shows a sub routine of the interpolate operation S3 in FIG. 8.
FIG. 12 shows a sub routine of the correction value determining operation S4 in FIG. 8.

After the accumulated heat amount in the substrate for each group is completed, an interpolation process S3 for interpolating the group division estimated accumulated heat amounts Pg1(j) into the estimated accumulated heat amounts in regions of the substrate corresponding to respective heat elements $r_0$–$r_{N-1}$ is performed. As is shown in FIG. 11, in the interpolation process S3, each difference between adjacent group division estimated accumulated heat amounts Pg1(j) and Pg1(j+1) is divided by the number n of heat elements in one group, so as to obtain an estimated accumulated heat amount step PK for each heat element. The accumulated heat amounts for respective heat elements are obtained by adding an integer multiple of the estimated accumulated heat amount step PK to the group division estimated accumulated heat amount for the group to which the heat element belongs. The interpolation of the group division estimated accumulated heat amount between the jth group and the (j+1) the group is specifically described as an example. First, the estimated accumulated heat amount step PK is added to the group division estimated accumulated heat amount Pg1 (j) for the jth group. As a result, the estimated accumulated heat amount for the first heat element in the jth group is obtained. The estimated accumulated heat amount step PK is further added, so that the estimated accumulated heat amount for the second heat element in the jth group is obtained. That is, the estimated accumulated heat amount for the ith heat element is obtained by adding the estimated accumulated heat amount step PK of the group to which the ith heat element belongs, to the estimated accumulated heat amount for the (i−1)th heat element. In such a way, the interpolation for each heat element between respective group division estimated accumulated heat amounts Pg1(j) and Pg(j+1) is sequentially performed (S301–S307). Especially, the interpolation in the group positioned at either one of the ends of the thermal head 102 is performed considering the group of virtual heat elements which do not contribute to the printing (S308–S315). The interpolation section 105 is realized by the interpolation process S3.

After the interpolation process S3, the correction value determining process S4 for determining the correction value for each heat element is performed. As is shown in FIG. 12, in the correction value determining process S4, the body portion temperature $T_3$ is read from the head temperature detecting section 103 (S401). Next, the correction value K1(i) or K2(i) for each heat element is derived from Expression (8-A) or (8-B) (S402–S404). The correction value determining section 106 is realized by the correction value determining process S4.

Figure 13:
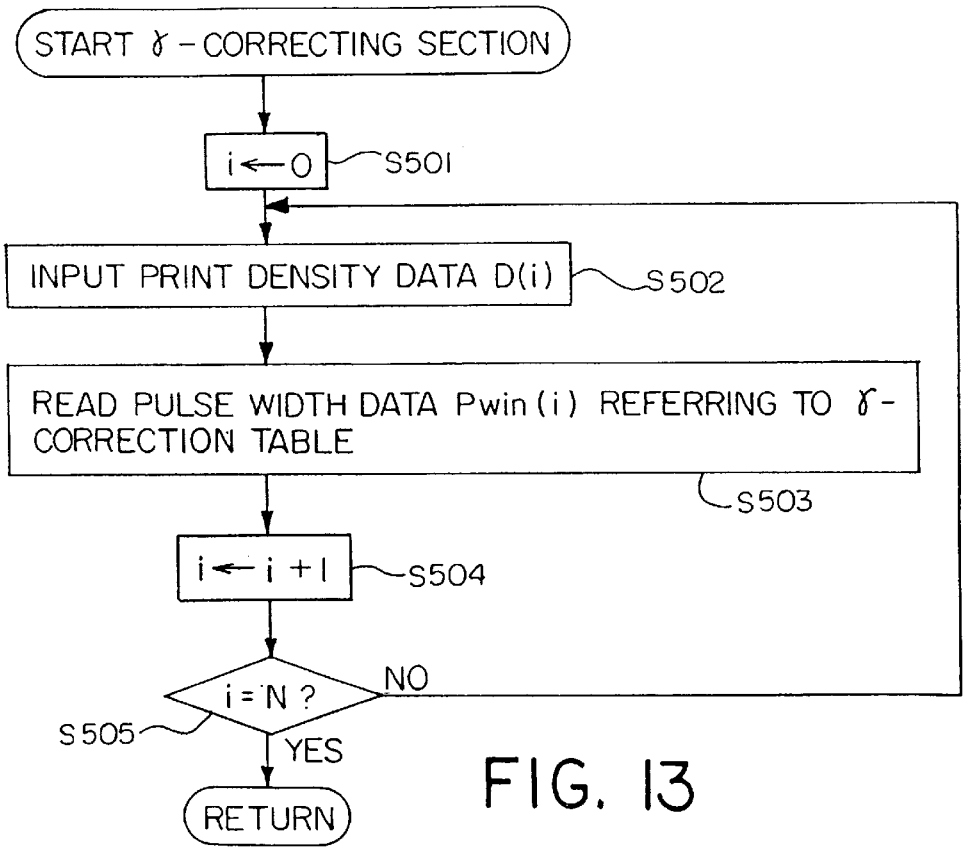
FIG. 13 shows a sub routine of the γ-correction operation S5 in FIG. 8.

Then, the γ-correcting process S5 for correcting the non-linear relationship called the γ-characteristics between the applied energy and the printed density is performed. As is shown in FIG. 13, in the γ-correcting process S5, the density data D(i) for the mth line corresponding to the gradation to be printed for each pixel is input, and supplied to the γ-correction table which is previously stored in the ROM 702. Then, the pulse width data Pwin(i) which is necessary for reproducing the density represented by the data D(i) and is supplied to each heat element is read out (S501–S505). The γ-correcting section 101 is realized by the γ-correcting process S5.

Figure 14:
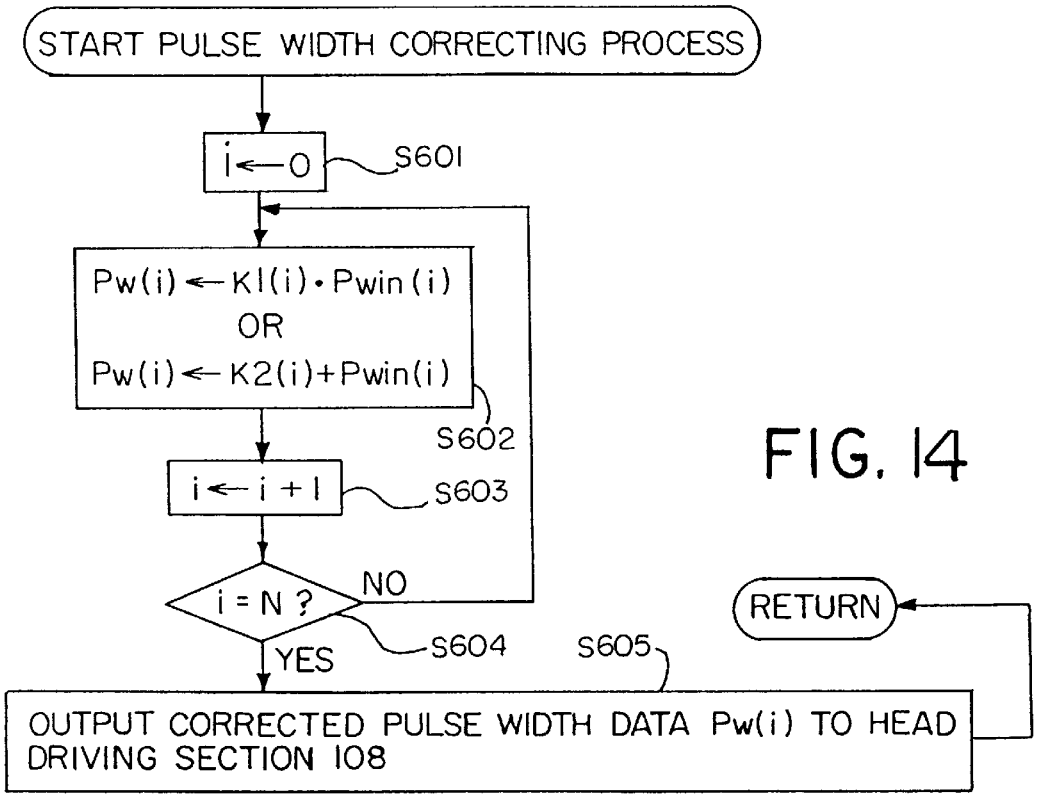
FIG. 14 shows a sub routine of the pulse width correction operation S6 in FIG. 8.

The pulse width correcting process S6 for correcting the pulse width data Pwin(i) based on the correction value K1(i) or K2(i) is performed. As is shown in FIG. 14, in the pulse width correcting process S6, the correction value K1(i) or K2(i) is applied to the pulse width data Pwin(i) on the basis of Expression (9-A) or (9-B), so that the corrected pulse width data Pw(i) is derived (S601–S604). The corrected pulse width data Pw(i) for each heat element is output to the head driving section 108, so as to drive the thermal head 102 (S605). The pulse width correcting section 107 is realized by the pulse width correcting process S6.

When the above process S6 is terminated, the operation for the first line is completed. The operations for the second line and the succeeding lines are the same as that for the first line. After a predetermined number of lines (L lines) in the sub-scanning direction of one color is completed, the printing sheet is rewound and the thermal head 102 is adjusted to the printing position for the first line. Thus, the printings of the second color and the third color are performed in the same manner as in the printing of the first color.

Figure 15:
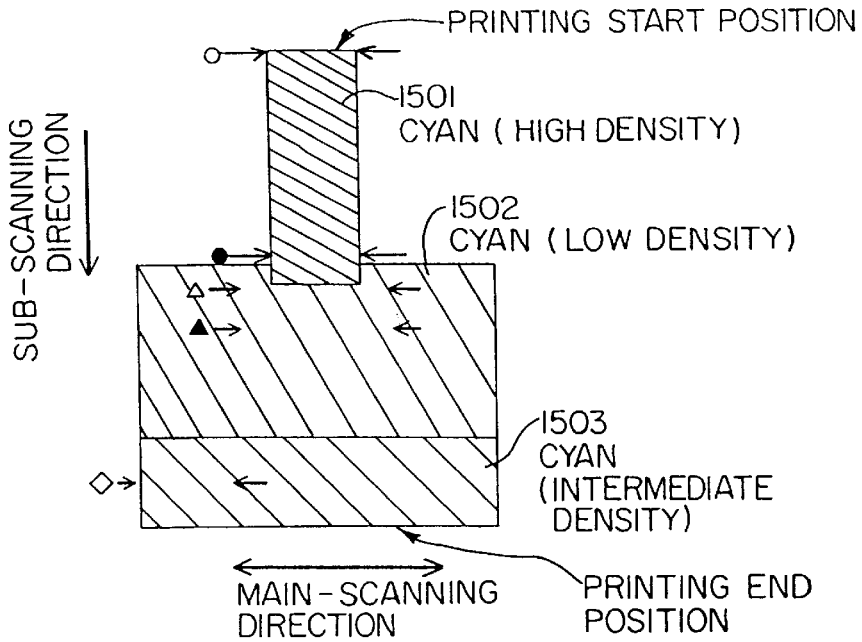
FIG. 15 illustrates the case of printing a pattern image having an intermediate gradation with a steep density distribution along a main-scanning direction.

For the comparison of the effects of this example with those of the conventional example, the case where a halftone pattern image having a steep density distribution along the main-scanning direction as is shown in FIG. 15 is to be printed is described. In FIG. 15, the density data for printing the high-density cyan 1501, the low-density cyan 1502, and the intermediate-density cyan 1503 is input.

Figure 16A:
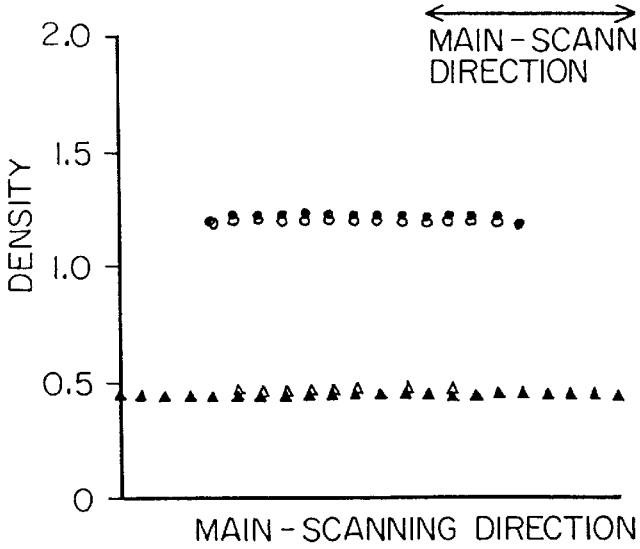
FIG. 16A is a diagram showing the density distribution of a cyan ink along the main-scanning direction at ○, ●, Δ, and ▲ when a pattern image of FIG. 15 as an input image is printed in the present example.
Figure 16B:
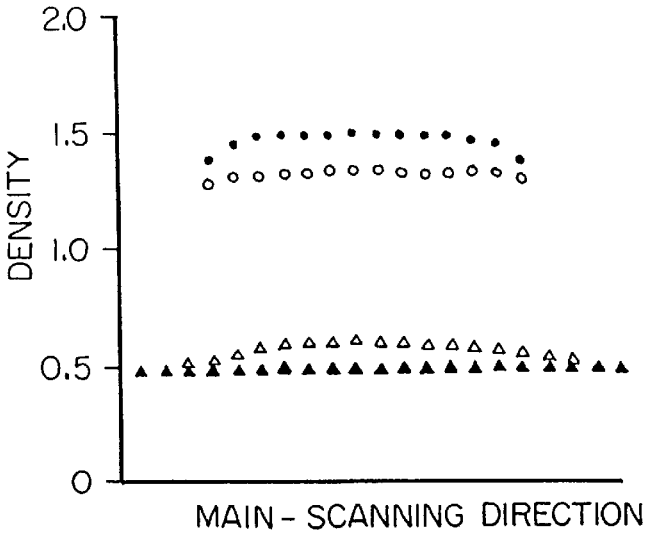
FIG. 16B is a diagram showing the density distribution of a cyan ink along the main-scanning direction at ○, ●, Δ, and ▲ when a pattern image of FIG. 15 as an input image is printed in the conventional example.
Figure 17B:
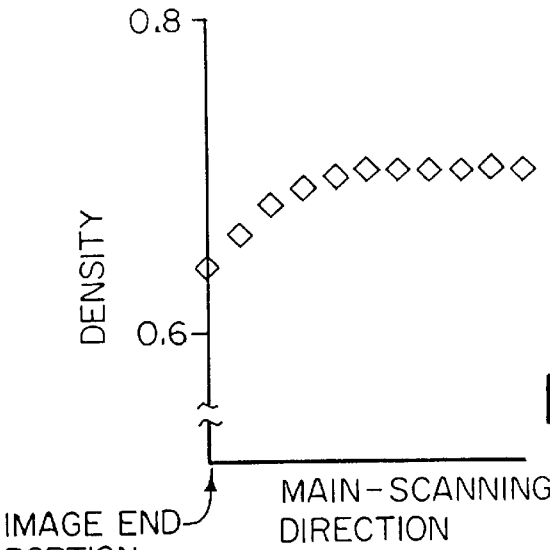
FIG. 17B is a diagram showing the density distribution of a cyan ink along the main-scanning direction at ◇ when a pattern image of FIG. 15 as an input image is printed in the conventional example.
Figure 17A:
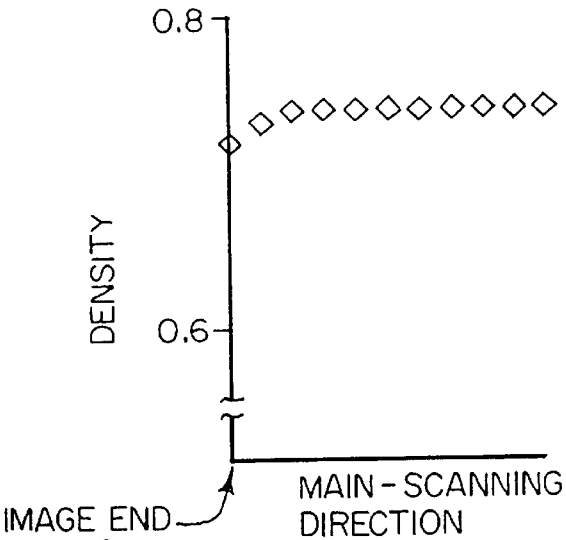
FIG. 17A is a diagram showing the density distribution of a cyan ink along the main-scanning direction at ◇ when a pattern image of FIG. 15 as an input image is printed in the present example.

FIGS. 16A and 16B show the density distributions of a cyan ink along the main-scanning direction between the arrows at ○, ●, Δ, and ▲ when the pattern image in FIG. 15 as the input image is printed. FIG. 16A shows the printed density when the printing is performed by the apparatus of this example. FIG. 16B shows the printed density when the printing is performed by the apparatus described in U.S. Pat. No. 5,066,961 as the above-mentioned first conventional example (hereinafter, referred to as the conventional apparatus). FIGS. 17A and 17B show the density distributions of a cyan ink along the main-scanning direction between the arrows at ◇ when the pattern image in FIG. 15 as the input image is printed by the apparatus of this example and by the conventional apparatus. The printing conditions are shown below in Table 1. In this example, the number n of heat elements in one group is set to be 64.

Table 1

Printing technique: Sublimation dye thermal transfer method

Printing speed: 16.4 msec./line

Driving method: 4-division driving

Applied energy: 0.21 W/dot

Resolution: 300 dpi

Number of printing pixels:

2048 dots (main-scanning direction)

3000 dots (sub-scanning direction)

It is understood from FIG. 16B that the printed density variations in the main-scanning direction at ○ and Δ are not improved by the conventional apparatus. In addition, in the sub-scanning direction, there arise density differences between ○ and ●, and between Δ and ▲. That is, it is understood that the density level compensation for thermal disturbance is not sufficiently performed by the conventional apparatus. On the contrary, as is shown in FIG. 16A, according to this example, the density variation in the main-scanning direction at ○ and Δ is reduced as compared with the case of the conventional apparatus. In the sub-scanning direction, there are almost no density differences between ○ and 574 , and between Δ and ▲. As is apparent from the above, the apparatus of this example can largely improve the printed density variation as compared with the conventional apparatus.

FIGS. 17A and 17B plot the density between arrows at ◇ in the pattern image shown in FIG. 15. As is shown in FIG. 17B, in the case of the conventional apparatus, the printed density at the edge portions of the image is reduced. As is shown in FIG. 17A, in this example, the density at the edge portions of the image is not reduced, and is improved so as to be substantially a uniform printed density. As is understood from the above description, according to this example, an image having large density variation in the main-scanning direction which could not be reproduced by the conventional apparatus can be accurately reproduced, and the reduction of the printed density at the edge portions of the image in the main-scanning direction can be largely improved.

As described above, according to the first example, by using the group division accumulated heat amount estimating section 104, the heat elements in the thermal head are divided into groups, and the accumulated heat amount in the substrate corresponding to the region of each group in the main-scanning direction is estimated. As a result, the calculation amount can be reduced to be substantially 1/n as compared with the case where the accumulated heat amounts are estimated for all the heat elements.

In the group division accumulated heat amount estimating section 104, the calculation of accumulated heat amount is performed considering the region of the substrate in which n virtual heat elements which do not contribute to the printing at each of both the ends of the thermal head 102, whereby the density reduction at the edge portions in the printed image can be corrected.

In addition, by using a recurrence equation of Expression (5) for the calculation of the accumulated heat amount for each group to be estimated, the accumulated heat amounts caused in the printing for all the previous lines can accurately be obtained by a small amount of calculation for each line.

Furthermore, in the correction value determining section 106, the correction value is represented by a general expression considering the influence by the accumulated heat amount in the main-scanning direction. Therefore, the correction value is very accurately determined by calculation based on the output of the γ-correcting section, the characteristics of the thermal head and the applied energy.

By the interpolating section 105 for interpolating the group division estimated accumulated heat amounts into the estimated accumulated heat amounts corresponding to the respective heat elements, the accuracy of the density level compensation for thermal disturbance is improved. In addition, the accumulated heat amounts are estimated in view of the influence in the main-scanning direction as well as the influence in the sub-scanning direction. As the result of such a process, the printed density variation due to the change of the ambient temperature or the heat accumulation of the thermal head itself can be accurately corrected, so that the density of all gradation levels can be accurately reproduced even for the image including a steep density variation. Accordingly, it is possible to stably attain many effects such as the printing of images of high quality without being affected by the type of the input image.

Next, the second example of the invention will be described with reference to the relevant figures.

Figure 18:
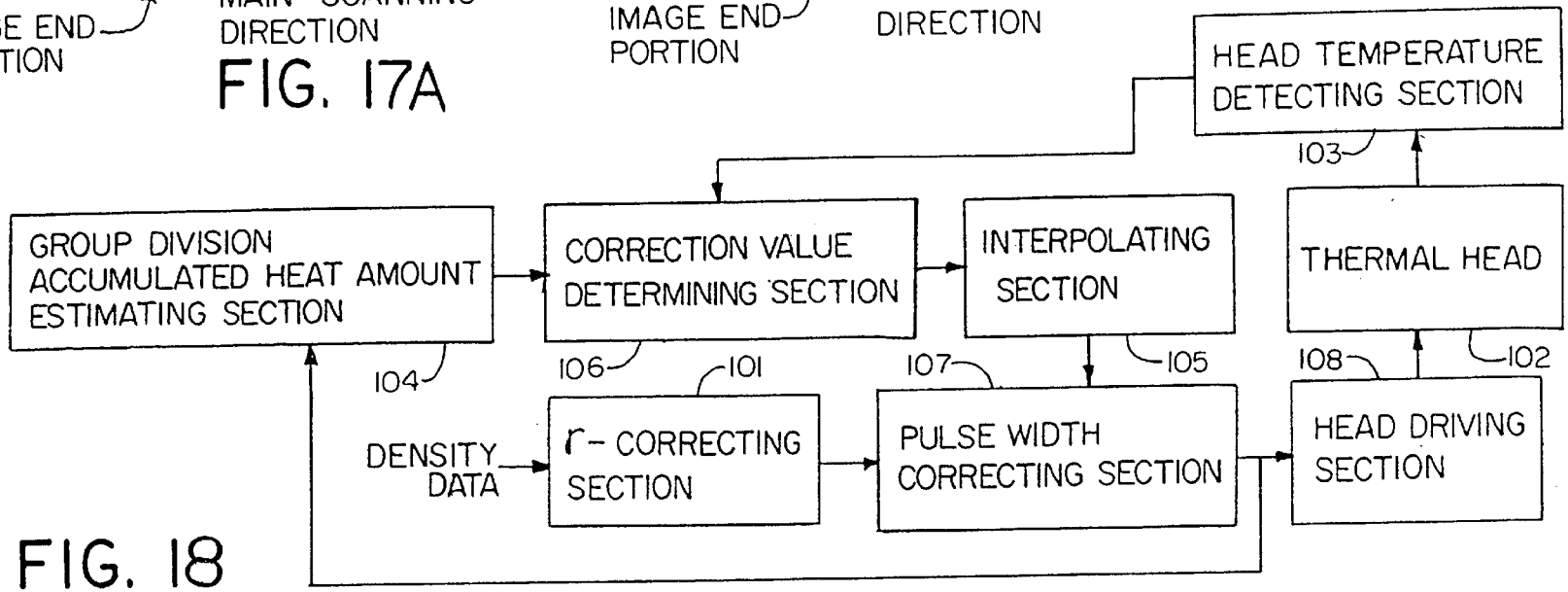
FIG. 18 shows a construction of a thermal gradation printing apparatus in a second example according to the invention.

FIG. 18 shows a construction of a thermal gradation printing apparatus in the second example according to the invention. In FIG. 18, the sections other than the sections 105 and 106 are identical with those in the first example. The correction value determining section 106 determines a correction value for each group, based on the output from the head temperature detecting section 103 and the output from the group division accumulated heat amount estimating section 104. The interpolating section 105 interpolates the output from the correction value determining section 106 into the correction value for a corresponding heat element.

Here, the correction value to be applied to the pulse width data is described by using the group division estimated accumulated heat amounts $Pg(m)_j$ shown in Expression (5). As described in the first example, it is found as the result of experiments by the inventors that Expression (10-A) shows good characteristics during the low-speed printing, and Expression (10-B) shows good characteristics during the high-speed printing.

$$K3(m)_j = \frac{A_1}{A_2 + T_3(m) + Pg(m)_j} \tag{10-A}$$

$$K4(m)_j = A_3 \cdot (T_3(m) + Pg(m)_j) + A_4 \tag{10-B}$$

The correction values $K3(m)_1$ and $K4(m)_j$ for each group shown by Expressions (10-A) and (10-B) are linearly interpolated as shown by Expressions (11-A) and (11-B), respectively, so as to correspond to each heat element, and the interpolated correction values are represented by $K3(m)_i$ and $K4(m)_i$, respectively.

$$K3(m)_i = K3(m)_j + \{K3(m)_{j+1} - K3(m)_j\} \cdot k/n \tag{11-A}$$

$$K4(m)_i = K4(m)_j + \{K4(m)_{j+1} - K4(m)_j\} \cdot k/n \tag{11-B}$$

where i is an integer in the range of 0 to N−1, j is an integer portion of (i/n), and k is a remainder obtained by dividing i by n.

Then, to the pulse width data $Pwin(m)_i$ obtained by the γ-correcting section 101, the correction value $K3(m)_i$ or $K4(m)_i$ is applied, on the basis of Expression (12-A) during the low-speed printing or Expression (12-B) during the high-speed printing. Accordingly, the corrected pulse width data $Pw(m)_i$ to be output to the head driving section 108 is calculated.

$$Pw(m)_i = K3(m)_i \cdot Pwin(m)_i \tag{12-A}$$

$$Pw(m)_i = K4(m)_i + Pwin(m)_i \tag{12-B}$$

Figure 19:
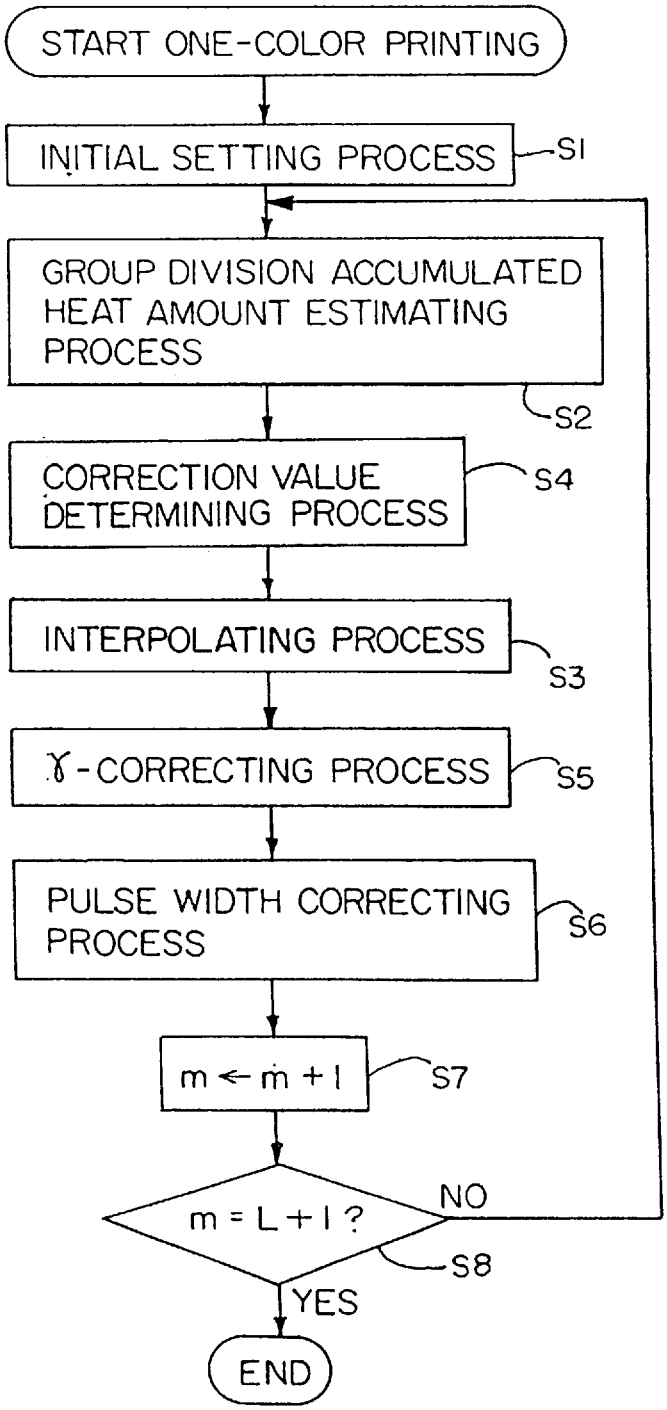
FIG. 19 is a flowchart illustrating the density level compensation for thermal disturbance in one embodiment of the second example of the invention, especially, during one color printing.

One embodiment of the construction of the second example is shown in FIG. 7 the same as for the first example. FIG. 19 is a flowchart for the density level compensation for thermal disturbance in one color printing by the embodiment shown in FIG. 7. In FIG. 19, processes S1–S8 are the same processes as in the first example, but the orders of the interpolating process S3 and the correction value determination process S4 are reversed from those in the first example.

Hereinafter, based on the above-mentioned expressions required for the density level compensating operation for thermal disturbance, the density level compensation for thermal disturbance is described in detail with reference to FIGS. 18 and 19. In the second example, as is shown in FIG. 19, the initial setting process S1 is performed in the same way as in the first example. After the accumulated heat amounts in the substrate for respective groups are estimated (S2), the correction value determining process S4 is performed. In the correction value determining process S4, the correction values for respective groups are calculated on the basis of the group division estimated accumulated heat amounts Pg1(j). The calculation of the correction values for respective groups can be performed by the same process as in the first example by replacing the accumulated heat amounts Pg1(j) for each group by the correction value Kg3(i) or Kg4(i) for each heat element in the sub-routine of the interpolating process S3 shown in FIG. 11.

Moreover, the γ-correcting process S5 and the pulse width correcting process S6 are successively performed, but they are the same as those in the first example. Thus, the operation for one line is completed. For the second line and the succeeding lines, the same operation as that for the first line is performed. The variable m indicates the number of printing lines. After the printing for the predetermined number of lines (L lines) along the sub-scanning direction in one color is completed, the printing sheet is rewound, and the thermal head 102 is adjusted to the printing position for the first line. Then, the printing for the second color and the third color is performed as that for the first color.

As described above, according to the second example, in the correction value determining process, the correction value for each group is determined by the correction value determining section 106 using the estimated accumulated heat amount for each group, so that the calculation amount can be reduced as compared with the process for determining the correction value for each heat element used in the first example. Therefore, the present example is advantageous for the high-speed printing with short 1-line period. More-over, the use of the interpolating section 105 for interpolating the correction value for each group into the correction value corresponding to each heat element can improve the compensation accuracy as compared with the density level compensation for thermal disturbance only using the group divisions. The use of the interpolating section 105 can attain the same effects as those in the first example, as compared with the above-mentioned conventional examples.

Next, the third example of the invention will be described with reference to relevant figures.

Figure 20:
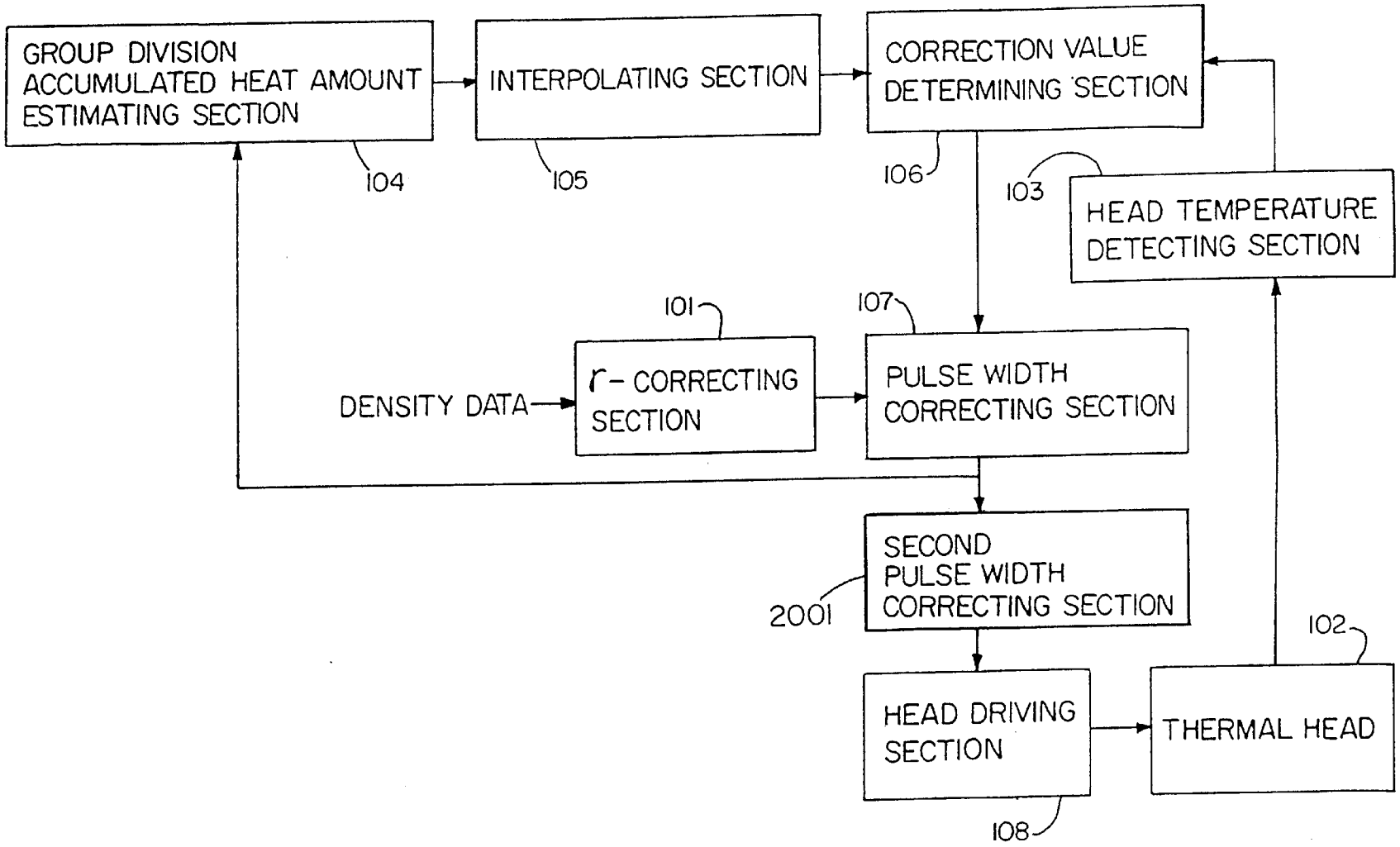
FIG. 20 shows a construction of a thermal gradation printing apparatus in a third example according to the invention.

FIG. 20 shows the construction of a thermal gradation printing apparatus in the third example according to the invention.

In FIG. 20, the sections 101 to 108 are identical with those in the first example. The apparatus in the third example further includes a second pulse width correcting section 2001 for performing the operation of the differentiation of the corrected pulse width data output from the pulse width correcting section 107, between the pulse width correcting section 107 and the head driving section 108.

Figure 21:
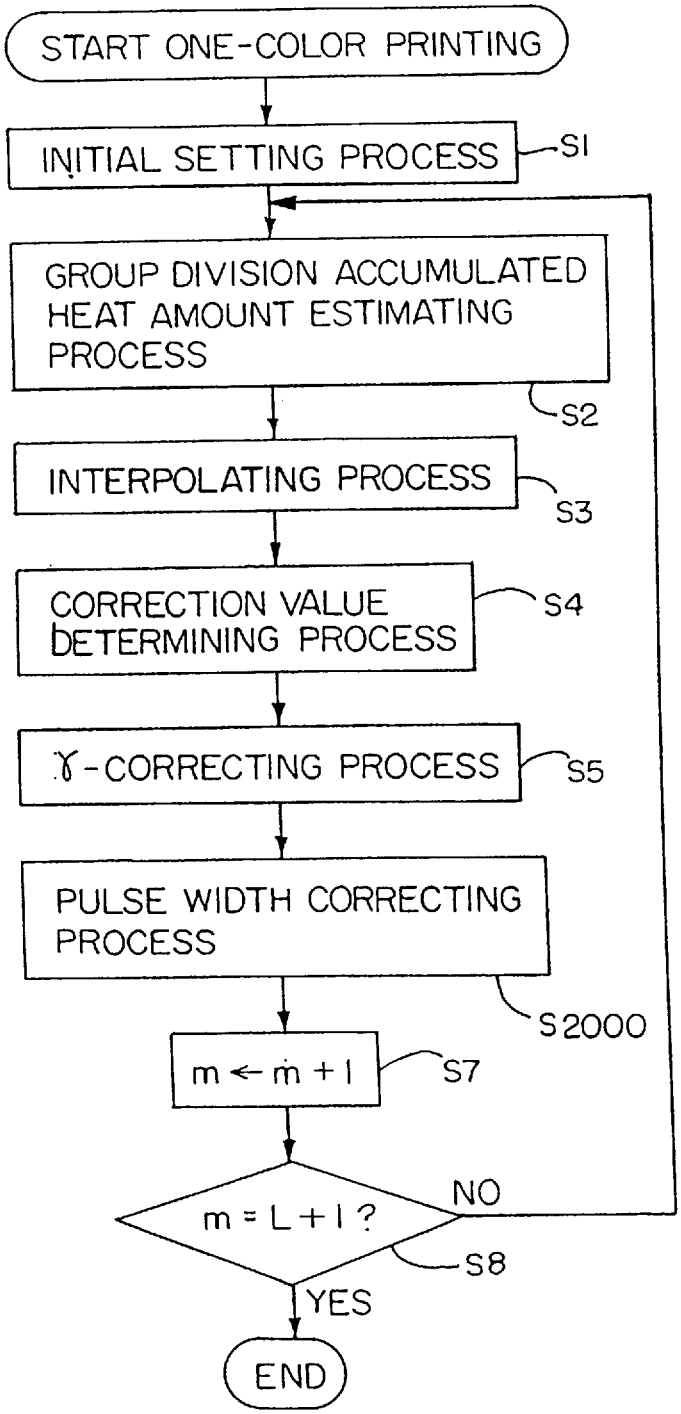
FIG. 21 is a flowchart illustrating the density level compensation for thermal disturbance in one embodiment of the third example of the invention, especially, during one color printing.
Figure 22:
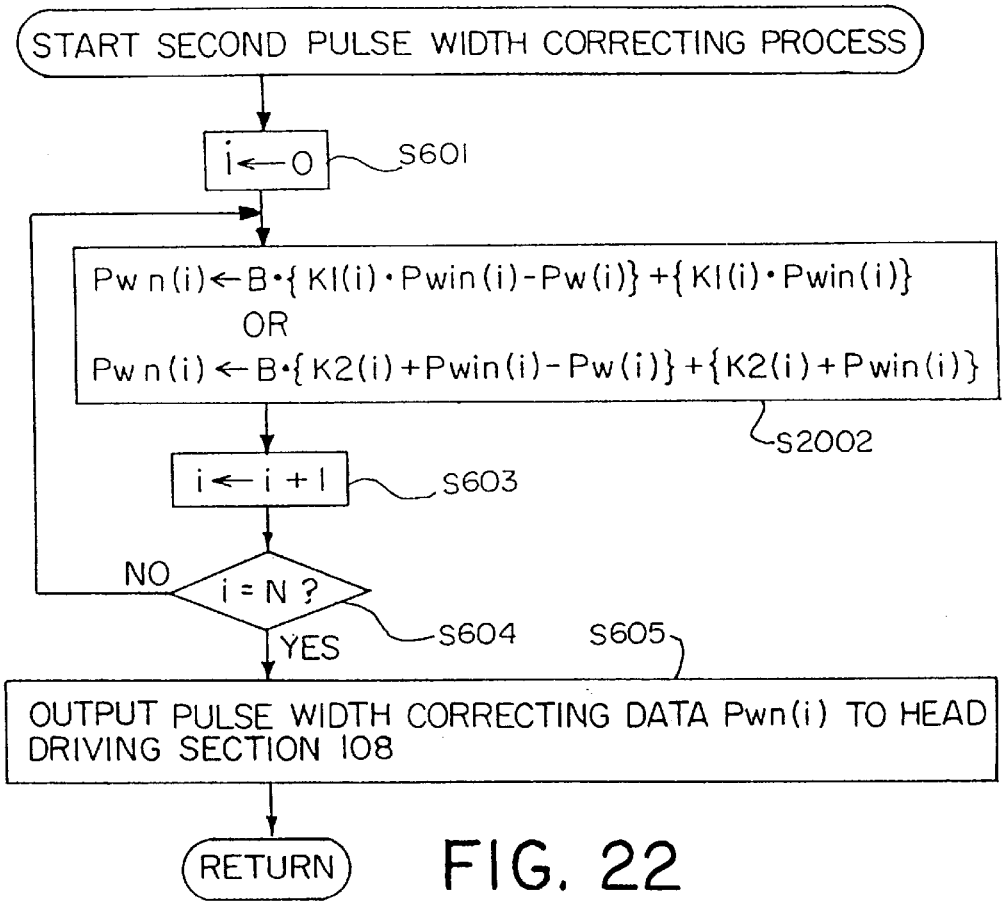
FIG. 22 shows a sub routine of the pulse width correction operation S2000 in FIG. 21.

One embodiment of the third example is shown in FIG. 7 the same as for the first example. FIGS. 21 and 22 are flowcharts illustrating the density level compensation for thermal disturbance in one color in the third example. In FIG. 21, processes S1–S5, S7, and S8 are the same processes as those in the first example. FIG. 22 specifically describes the sub routine of the pulse width correcting process S2000 in FIG. 21.

The pulse width correcting process S2000 for correcting the pulse width data is realized by the combination of S602 in the pulse width correcting process S6in the first example and the second pulse width correcting process S2002 performing the operation of the differentiation of the corrected pulse width data Pw(i).

In the pulse width correcting process S2000, a difference between the corrected pulse width data {K1(i)·Pwin(i)} for the current line and the corrected pulse width data Pw(i) supplied to the heat element during the printing of the previous line is multiplied with the predetermined coefficient B. The resulting value is added to the corrected pulse width data {K1(i)·Pwin(i)} for the current line, so as to obtain new corrected pulse width data Pwn(i). Alternatively, the difference between the corrected pulse width data {K2(i)+Pwin(i)} for the current line and the corrected pulse width data Pw(i) supplied to the heat element during the printing of the previous line is multiplied with the predetermined coefficient B. The resulting value is added to the corrected pulse width data {K2(i)+Pwin(i)} for the current line, so as to obtain new corrected pulse width data Pwn(i). The new data Pwn(i) is output to the head driving section 108, so as to drive the thermal head 102. The combination of the pulse width correcting section 107 and the second pulse width correcting section 2001 is realized by the pulse width correcting process S2000.

Thus, the operation for one line is completed. For the second line and the succeeding lines, the same operation as that for the first line is performed. The variable m indicates the number of printing lines. After the printing for the predetermined number of lines (L lines) along the sub-scanning direction in one color is completed, the printing sheet is rewound and the thermal head 102 is adjusted to the printing position for the first line. Then, the printing for the second color and the third color is performed as that for the first color.

Figure 23A:
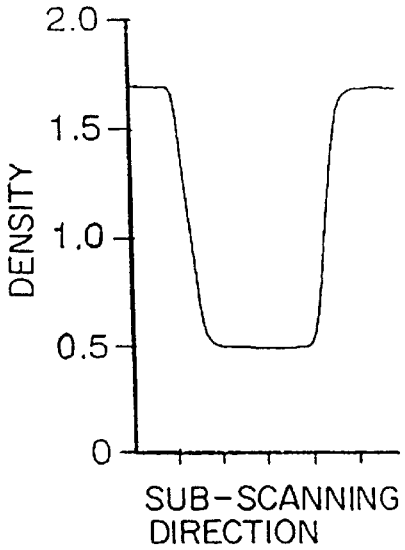
FIG. 23A shows a density distribution along a sub-scanning direction when the printing of high-density, low-density, and high-density is performed by the present example.
Figure 23B:
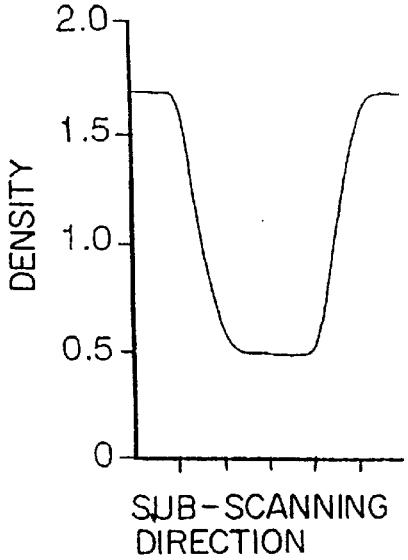
FIG. 23B shows a density distribution along a sub-scanning direction when the printing of high-density, low-density, and high-density is performed by the conventional example.

FIGS. 23A and 23B show density distributions along a sub-scanning direction when printing of high-density, low-density, and high-density is performed by the apparatus of the third example and by the conventional apparatus. The printing conditions are shown in Table 2. In this example, the number n of heat elements in one group is 64, and the coefficient B used in the pulse width correcting process S2000 is 0.3.

Table 2

Printing technique: Sublimation dye thermal transfer method

Printing speed: 8.2 msec./line

Driving method: Simultaneous driving

Applied energy: 0.075 W/dot

Resolution: 300 dpi

Number of printing pixels:

2048 dots (main-scanning direction)

3000 dots (sub-scanning direction)

As is seen from FIG. 23B, when the printing is performed by the conventional apparatus, the edges at the rising and the falling of the density level may be dull. This is because the thermal transition response determined by the thermal time constant $C_1R_1$ of the heat element itself is deteriorated. According to this example, as is seen from FIG. 23A, the edges at the rising and the falling of the density level due to the third heat accumulation can be improved so as to be steep.

As described above, according to the third example, during the high-speed printing, the use of the second pulse width correcting section 2001 can eliminate the degradation of the image due to the third heat accumulation in the heat element, and can improve the image quality by eliminating the blur of the image due to the dullness of the rising and falling edges of the density level.

Next, the fourth example of the invention will be described.

Figure 24:
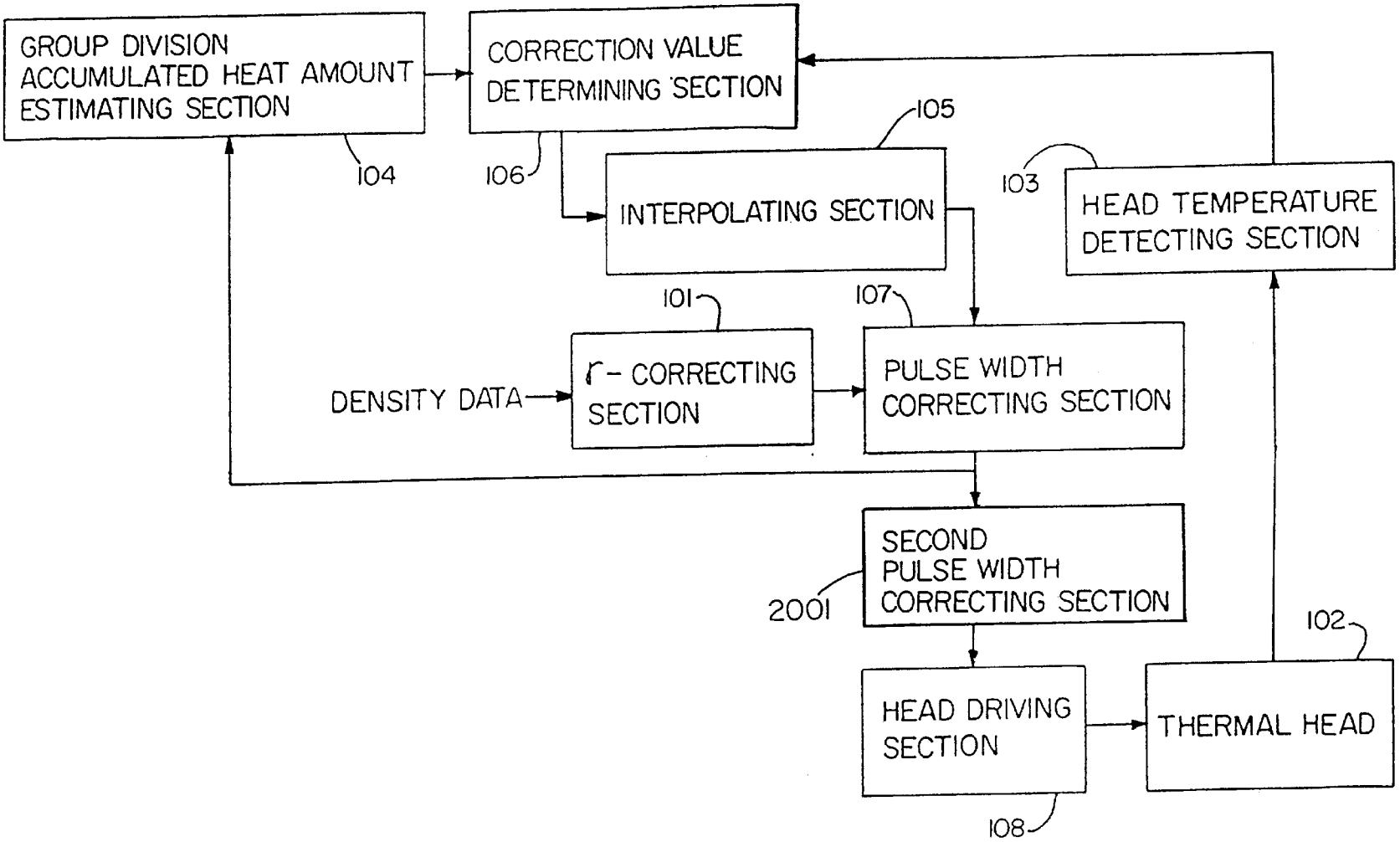
FIG. 24 shows a construction of a thermal gradation printing apparatus in a fourth example according to the invention.

FIG. 24 shows the construction of a thermal gradation printing apparatus in the fourth example according to the invention.

In FIG. 24, the sections 101 to 108 are identical with those in the second example, and the second pulse width correcting section 2001 operates in the same way as in the third example.

With such a construction, according to the fourth example, during the high-speed printing, the use of the second pulse width correcting section 2001 can eliminate the degradation of the image due to the third heat accumulation in the heat element, and can improve the image quality by eliminating the blur of the image due to the dullness of the rising and falling edges of the density level.

In the third and fourth examples, the second pulse width correcting section 2001 performs the operation of the differentiation of the corrected pulse width data output from the pulse width correcting section 107. In an alternative example, the second pulse width correcting section 2001 may perform the operation of the differentiation of the pulse width data output from the γ-correcting section 101.

In the first to fourth examples of the invention, the embodiments are realized in software by a microcomputer. In the fifth example which is described below, the pulse width correcting section 107 is realized by the construction of hardware. The fifth example describes the case of low-speed printing, i.e., the case where the correction value K1(m)i shown by Expression (8-A) is multiplied by the pulse width data $Pwin(m)_i$ output from the γ-correcting section 101 as shown in Expression (9-A) and thus the corrected pulse width data $Pw(m)_i$ is obtained.

Figure 25:
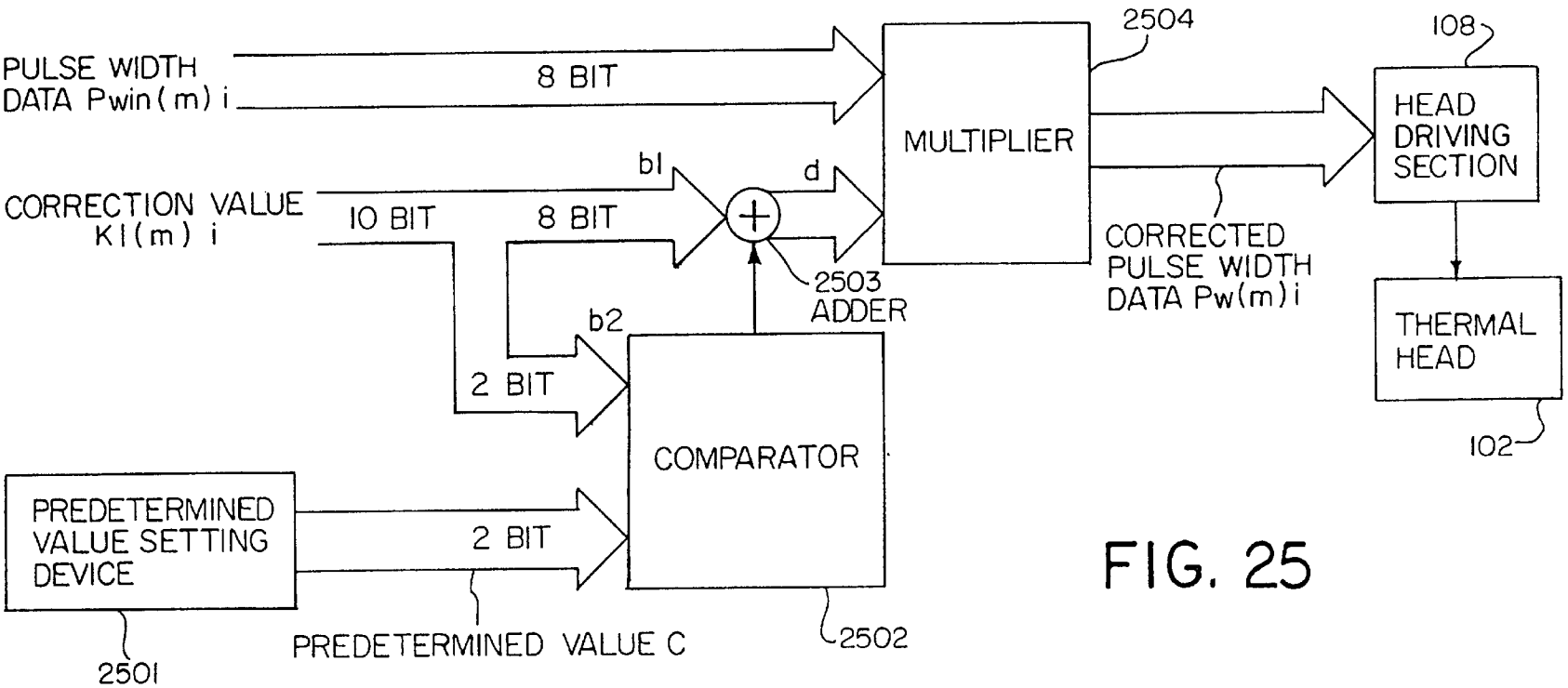
FIG. 25 is a circuit block diagram of the pulse width correcting section in a thermal gradation printing apparatus in a fifth example according to the invention.

FIG. 25 is a circuit block diagram of the pulse width correcting section 107 in the thermal gradation printing apparatus in the fifth example. In the current state, 8-bit data is mainly used as the input digital RGB data. In order to perform 8-bit gradation printing (256 levels) by the thermal gradation printing apparatus, it is basically necessary to set the pulse width data output to the thermal head to be at least 8 bits. Accordingly, in this example, the pulse width data $Pwin(m)_i$, the corrected value $K1(m)_i$, and a predetermined value c are represented by 8 bits (k=8), 10 bits (n=10), and 2 bits (m=2), respectively.

As is shown in FIG. 25, the pulse width correcting section 107 includes a predetermined value setting device 2501 for setting a predetermined value c to be $2^m$ different values for every $2^m$ lines, a comparator 2502 for comparing the lower 2-bit data b2 of the correction value $K1(m)_i$ with the predetermined value c, an adder 2503 for adding the upper 8-bit data b1 of the correction value $K1(m)_i$ with the output from the comparator 2502 and for setting a new correction value d, and a multiplier 2504 for multiplying the pulse width data $Pwin(m)_i$ by the new correction value d.

Next, the fifth example will be specifically described with reference to FIG. 25. The correction value $K1(m)_i$ (10 bits) which has been previously set is divided into two data of upper 8-bit data b1 and lower 2-bit data b2. The upper 8-bit data b1 is input into the adder 2503, and the lower 2-bit data b2 is input into the comparator 2502. Table 3 shows the predetermined value c which is an output from the predetermined value setting device 2501.

TABLE 3

| | | | | | | | | | | |
|---|---|---|---|---|---|---|---|---|---|---|
| Printing line number | 1 | 2 | 3 | 4 | 5 | 6 | 7 | 8 | 9 | ... |
| Predetermined value | 0 | 2 | 1 | 3 | 0 | 2 | 1 | 3 | 0 | ... |

As is shown in Table 3, four values of 0, 2, 1, and 3 of the predetermined value c corresponding to the respective printing line number are repeated for every 4 lines, and input into the comparator 2502. In the comparator 2502, the input data b2 is compared with the predetermined value c. If the data b2 is larger than the predetermined value c, a value of 1 is output. If the data b2 is equal to or smaller than the predetermined value c, a value of 0 is output. The adder 2503 receives the output from the comparator 2502 and the upper 8-bit data b1 of the correction value $K1(m)_i$. In the adder 2503, the received data are added, and the result is output as an output data d to the multiplier 2504. The multiplier 2504 receives the pulse width data $Pwin(m)_i$ (8bits) and the output data d of the adder 2503. The received data are multiplied, so as to output the corrected pulse width data $Pw(m)_i$ constituted of the upper 8 bits of the multiplied result to the head driving section 108. In addition, the head driving section 108 supplies a power to respective heat elements for a time period determined in accordance with the corrected pulse width data $Pw(m)_i$ output from the multiplier 2504. Therefore, the power supply time period for each heat element in the thermal head 102 is variable, so that the heat generating energy has multiple levels for each heat element. Accordingly, it is possible to perform a multilevel printing for each pixel by using a sublimation dye.

After the printing for one line is. completed by the above-described operation, the pulse width data $Pwin(m+1)_i$ and the correction value $K1(m+1)_i$ for the next line are input again, and the predetermined value setting device 2501 outputs a predetermined value c having a value corresponding the printing line number as shown in Table 3 to the comparator 2502.

Here, the effects of this example will be described based on a specific example. First, it is assumed that the pulse width data $Pwin(m)_i$ is 80H (8 bits) (the suffix letter H indicates a hexadecimal number), and that the correction value $K1(m)_i$ is 202H (10 bits). The correction value $K1(m)_i$ is set in such a manner that the most significant bit indicates an integer and the lower 9 bits indicate the value after the decimal point as is shown by Expression (18), so that 202H can be represented by 1+(1/256).

$$202H = 1.000000010(\text{in binary notation}) = 1 + \frac{1}{256} \tag{18}$$

By calculating the above specific example using the decimal system, the pulse width data $Pwin(m)_i$ is 128, and the correction value $K1(m)_i$ is 1+(1/256) as shown in Expression (18). As a result, the multiplied result is 128.5 as shown by Expression (19).

$$128\times\{1+(1/256)\}=128.5 \tag{19}$$

If the number of bits in the correction value is increased in order to enhance the correction accuracy, the value of 128.5 cannot be attained, because the correction pulse width data $Pw(m)_i$ is 8-bit data. Accordingly, the value after the decimal point is raised or discarded, and an approximate value of 128.5 is used for the printing. As a result, the correction accuracy is degraded.

However, in this example, the comparator 2502 compares 2H of the lower 2 bits of the correction value $K1(m)_i$ with the predetermined value in Table 3. The output of the comparator 2502 is 1 for the first line and the third line, and 0 for the second line and the fourth line. Therefore, the outputs of the multiplier 2504 for the first to fourth lines are 81H, 80H, 81H, and 80H, respectively. The printing using such outputs is equivalent to the printing using a pseudo intermediate value between 80H and 81H, i.e., 128.5 in Expression (19) if four lines are regarded as a unit. Thus, it is unnecessary to increase the number of bits in the correction pulse width data $Pw(m)_i$, so that the correction accuracy can be improved without causing the increase in the circuit scale along with the increase in the data transfer speed to the head driving section 108, and without causing the increase in size of the construction of the multiplier 2504.

A thermal gradation printing apparatus in the sixth example will be described with reference to relevant figures.

Figure 26:
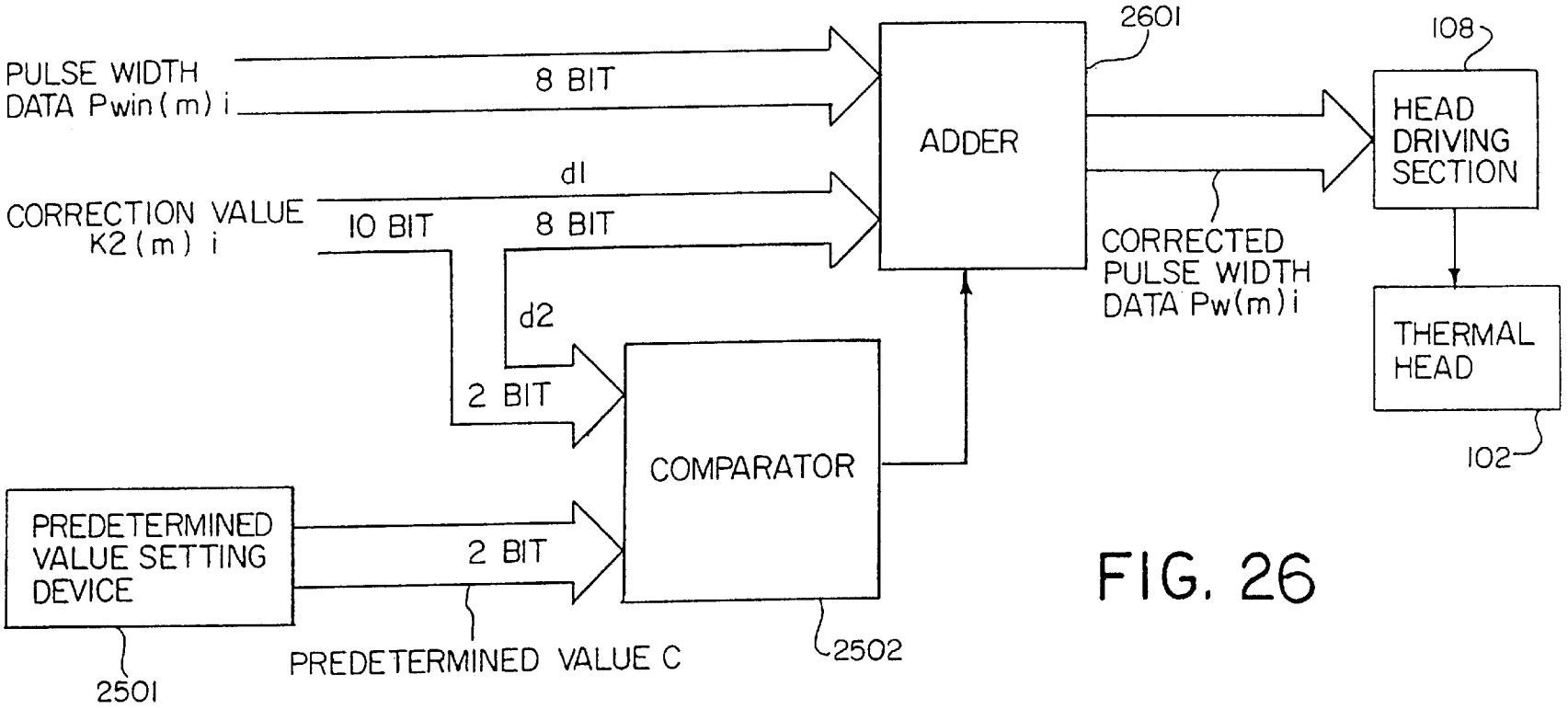
FIG. 26 is a circuit block diagram of a pulse width correction section in a thermal gradation printing apparatus in a sixth example according to the invention.

FIG. 26 is a circuit block diagram of the pulse width correcting section 107 in the thermal gradation printing apparatus in the sixth example. In the thermal gradation printing apparatus in the sixth example, the pulse width correcting section 107 is realized by hardware construction. The sixth example describes a case of the high-speed printing, i.e., a case where the correction value $K2(m)_i$ in Expression (8-B) is added to the pulse width data $Pwin(m)_i$ output from the γ-correcting section 101 as is shown by Expression (9-B), and thus the corrected pulse width data $Pw(m)_i$ is obtained. In this example, the same as in the fifth example, it is assumed that the pulse width data $Pwin(m)_i$ and the correction value $K2(m)_i$, and the predetermined value c are 8 bits (k=8), 10 bits (n=10), and 2 bits (m=2), respectively.

In FIG. 26, the sections 2501 and 2502 are identical with those in the fifth example, so that the descriptions thereof are omitted. The pulse width correcting section 107 in the sixth example further includes an adder 2601 which adds the pulse width data $Pwin(m)_i$, the upper 8-bit data d1 of the correction value $K2(m)_i$, and the output of the comparator 2502. Then, the adder 2601 outputs the corrected pulse width data $Pw(m)_i$.

Next, the sixth example will be specifically described with reference to FIG. 26. The correction value $K2(m)_i$ which has been previously set is divided into two data of upper 8-bit data d1 and lower 2-bit data d2. The upper 8-bit data d1 is input into the adder 2601, and the lower 2-bit data d2 is input into the comparator 2502. The predetermined value c which is output from the predetermined value setting device 2501 is shown in Table 3, the same as in the fifth example.

As is shown in Table 3, four values of 0, 2, 1, and 3 of the predetermined value c corresponding to the respective printing line number are repeated for every 4 lines, and input into the comparator 2502. In the comparator 2502, the input data d2 is compared with the predetermined value c. If the data d2 is larger than the predetermined value c, a value of 1 is output. If the data d2 is equal to or smaller than the predetermined value c, a value of 0 is output. The adder 2601 receives the pulse width data $Pwin(m)_i$, the upper 8-bit data d1 of the correction value $K2(m)_i$, and the output from the comparator 2502. In the adder 2601, the received data are added to each other, and the corrected pulse width data $Pw(m)_i$ which is represented by the upper 8 bits of the added result is output to the head driving section 108. In addition, the head driving section 108 supplies a power to respective heat elements for a time period determined in accordance with the corrected pulse width data $Pw(m)_i$ output from the adder 2601.

The operations for the second and succeeding lines after the printing for one line is completed by the above-described operation are the same as in the fifth example, so that the descriptions thereof are omitted.

Here, the effects of this example will be described based on a specific example. First, it is assumed that the pulse width data $Pwin(m)_i$ is 80H (8 bits) (the suffix letter H indicates a hexadecimal number), and that the correction value $K2(m)_i$ is 06H (10 bits). The correction value $K2(m)_i$ is set in such a manner that the upper 8 bits indicate an integer portion and the lower 2 bits indicate the value after the decimal point as is shown by Expression (20), so that 06H can be represented by 1+(½).

$$06H = 00000001.10(\text{in binary notation}) = 1 + \frac{1}{2} \tag{20}$$

By calculating the above specific example using the decimal system, the pulse width data $Pwin(m)_i$ is 128, and the correction value $K2(m)_i$ is 1+(½) as shown in Expression (20). As a result, the multiplied is result is 129.5 as shown by Expression (21).

$$128\times\{1+(½)\}=129.5 \tag{21}$$

If the number of bits in the correction value is increased in order to enhance the correction accuracy, the value of 129.5 cannot be attained, because the correction pulse width data $Pw(m)_i$ is 8-bit data. Accordingly, the value after the decimal point is raised or discarded, and an approximate value of 129.5 is used for the printing. As a result, the correction accuracy is degraded.

However, in this example, the comparator 2502 compares 2H of the lower 2 bits of the correction value $K2(m)_i$ with the predetermined value in Table 3. The output of the comparator 2502 is 1 for the first line and the third line, and 0 for the second line and the fourth line. Therefore, the outputs of the adder 2601 for the first to fourth lines are 82H, 81H, 82H, and 81H, respectively. The printing using such outputs is equivalent to the printing using a pseudo intermediate value between 81H and 82H, i.e., 129.5 in Expression (21) if four lines are regarded as a unit. Thus, it is unnecessary to increase the number of bits in the correction pulse width data $Pw(m)_i$, so that the correction accuracy can be improved without causing the increase in the circuit scale along with the increase in the data transfer speed to the head driving section 108, and without causing the increase in size of the construction of the multiplier 2504.

In the fifth and sixth examples, the pulse width correcting section 107 is described by way of a hardware construction. Alternatively, the same processes can be performed by a software construction, and the same effects can be attained. In the fifth and sixth examples, the predetermined value c takes four values of 2 bits. Alternatively, the predetermined value c can be set to be 1 bit, 3 bits, or more bits depending on the bit length of the correction values $K1(m)_i$ and $K2(m)_i$. Alternatively, the predetermined value c can be set, for example, to be 3, 1, 2, and 0 or 2, 0, 1, and 3 for the first to fourth lines, respectively. The cases for the correction values $K1(m)_i$ and $K2(m)_i$ are described. When the same processes are performed for the correction values $K3(m)_i$ and $K4(m)_i$ shown by Expressions (11-A) and (11-B), the same effects can be attained.

In the above examples of this invention, the γ-correcting section 101 is constructed as a table in the ROM 702 as one implementation shown in FIG. 7. Alternatively the γ-correcting section 101 can be constructed as a table in a ROM or RAM which is externally and separately provided. In the above examples, the input of the γ-corresponding section 101 is density data. It is appreciated that the input can be luminance data.

Moreover, in the above examples of this invention, the interpolation in the interpolating section 105 is a linear interpolation. If the interpolation is a non-linear interpolation such as a spline interpolation, the same effects can be attained.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A thermal gradation printing apparatus comprising:

a thermal head including a body portion, a substrate formed on said body portion, and a plurality of heat elements arranged in a line on said substrate;

head temperature detecting means for detecting the temperature of said body portion;

data generating means for generating a plurality of data units depending on density data units;

accumulated heat amount estimating means for estimating accumulated heat amounts of regions of said substrate for every one line, the regions corresponding to said plurality of heat elements, respectively;

correction value calculating means for calculating correction values assigned to said plurality of heat elements, respectively, based on the estimated accumulated heat amounts, and the temperature of said body portion;

data correcting means for correcting the plurality of data units based on the correction values; and head driving means for allowing said plurality of heat elements to heat in accordance with the corrected data units, wherein the correction value is represented by n bits, and wherein said data correcting means includes: comparing means for comparing a value represented by lower m bits of the correction value with a reference value, and for generating an output value, the output value having one of a first value when the value represented by the lower m bits is larger than the reference value and a second value when the value represented by the lower m bits is equal to or smaller than the reference value; reference value setting means for setting the reference value for each line; adding means for adding the output value from said comparing means to a value represented by upper (n-m) bits of the correction value, to generate a sum; and multiplying means for multiplying the sum by the plurality of data units generated by said data generating means, said reference value setting means setting different values for $2^m$ lines, respectively.

2. A thermal gradation printing apparatus comprising:

a thermal head including a body portion, a substrate formed on said body portion, and a plurality of heat elements arranged in a line on said substrate;

head temperature detecting means for detecting the temperature of said body portion;

data generating means for generating a plurality of data units depending on density data units;

accumulated heat amount estimating means for estimating accumulated heat amounts of regions of said substrate for every one line, the regions corresponding to said plurality of heat elements, respectively;

correction value calculating means for calculating correction values assigned to said plurality of heat elements, respectively, based on the estimated accumulated heat amounts, and the temperature of said body portion;

data correcting means for correcting the plurality of data units based on the correction values; and head driving means for allowing said plurality of heat elements to heat in accordance with the corrected data units, wherein the correction value is represented by n bits, and wherein said data correcting means includes: comparing means for comparing a value represented by lower m bits of the correction value with a reference value, and for generating an output value, the output value having one of a first value when the value represented by the lower m bits is larger than the reference value and a second value when the value represented by the lower m bits is equal to or smaller than the reference value; reference value setting means for setting the reference value for each line; and adding means for adding the output value from said comparing means, a value represented by upper (n-m) bits of the correction value, and the plurality of data units generated by said data generating means to each other, said reference value setting means setting different values for $2^m$ lines, respectively.

* * * * *